US011970358B2

(12) United States Patent
Miyachi et al.

(10) Patent No.: US 11,970,358 B2
(45) Date of Patent: Apr. 30, 2024

(54) MEDIUM FEEDING MECHANISM

(71) Applicant: RISO KAGAKU CORPORATION, Tokyo (JP)

(72) Inventors: Ryosuke Miyachi, Tsukuba (JP); Yuzuru Iioka, Tsukuba (JP)

(73) Assignee: RISO KAGAKU CORPORATION, Tokyo (JP)

( * ) Notice: Subject to any disclaimer, the term of this patent is extended or adjusted under 35 U.S.C. 154(b) by 110 days.

(21) Appl. No.: 17/321,746

(22) Filed: May 17, 2021

(65) Prior Publication Data

US 2021/0371222 A1 Dec. 2, 2021

(30) Foreign Application Priority Data

May 27, 2020 (JP) ..... 2020-092216
May 27, 2020 (JP) ..... 2020-092217
Mar. 26, 2021 (JP) ..... 2021-053050

(51) Int. Cl.
*B65H 7/02* (2006.01)
*B65H 5/06* (2006.01)
(Continued)

(52) U.S. Cl.
CPC ..... *B65H 7/02* (2013.01); *B65H 5/062* (2013.01); *B65H 5/26* (2013.01); *B65H 7/20* (2013.01);
(Continued)

(58) Field of Classification Search
CPC . B65H 5/062; B65H 5/26; B65H 7/02; B65H 7/04; B65H 7/14; B65H 7/20;
(Continued)

(56) References Cited

U.S. PATENT DOCUMENTS

2007/0041762 A1 2/2007 Ishida et al.
2012/0161388 A1* 6/2012 Yamagishi ..... B65H 9/006 271/226
(Continued)

FOREIGN PATENT DOCUMENTS

CN 105730030 7/2016
CN 110471265 11/2019
(Continued)

OTHER PUBLICATIONS

Office Action issued by the China National Intellectual Property Administration (CNIPA) in Chinese Patent Application No. 202110522411.7, dated Jan. 13, 2023, together with an English language translation.
(Continued)

*Primary Examiner* — Prasad V Gokhale
(74) *Attorney, Agent, or Firm* — Greenblum & Bernstein, P.L.C.

(57) ABSTRACT

A medium feeding mechanism includes a feeder that feeds a medium, a transportation path that is coupled to the feeder and includes a bent portion, a transporter that transports the medium on the transportation path, and a transportation control unit that controls the transporter, wherein the transportation control unit adjusts a transportation velocity of the medium transported by the transporter on the basis of medium information of the medium and a transportation route shape for the medium.

15 Claims, 16 Drawing Sheets

BENT PORTION(LARGE CORNER ANGLE)

(51) Int. Cl.
*B65H 5/26* (2006.01)
*B65H 7/20* (2006.01)

(52) U.S. Cl.
CPC .... *B65H 2301/312* (2013.01); *B65H 2513/10* (2013.01); *B65H 2557/30* (2013.01)

(58) Field of Classification Search
CPC ..... B65H 2301/312; B65H 2301/3123; B65H 2513/10; B65H 2513/42; B65H 2513/512
See application file for complete search history.

(56) References Cited

U.S. PATENT DOCUMENTS

| | | | | |
|---|---|---|---|---|
| 2015/0061212 | A1* | 3/2015 | Sugiyama | B65H 1/04 271/110 |
| 2015/0175368 | A1* | 6/2015 | Hiroi | B65H 5/062 271/265.01 |
| 2016/0185542 | A1 | 6/2016 | Inoue et al. | |
| 2021/0223725 | A1* | 7/2021 | Tomishima | G03G 15/65 |

FOREIGN PATENT DOCUMENTS

| | | |
|---|---|---|
| JP | 2005-298168 | 10/2005 |
| JP | 2007-086726 | 4/2007 |

OTHER PUBLICATIONS

Office Action from Japan Patent Office (JPO) in Japanese Patent Appl. No. 2020-092217, dated Jan. 30, 2024, together with an English language translation.

* cited by examiner

BENT PORTION(LARGE CORNER ANGLE)

BENT PORTION(MEDIUM CORNER ANGLE)

BENT PORTION(SMALL CORNER ANGLE)

<DIAGRAM INDICATING TRANSPORTATION TIMES OF MEDIA FED FROM FIRST FEEDER (THICK LINES) AND SECOND FEEDER (THIN LINES) IN ANOTHER EMBODIMENT (FIRST FEEDER v0=SECOND FEEDER v0)>

<DIAGRAM INDICATING TRANSPORTATION TIMES OF MEDIA FED FROM FIRST FEEDER (THICK LINES) AND SECOND FEEDER (THIN LINES) IN ANOTHER EMBODIMENT (FIRST FEEDER v0>SECOND FEEDER v0)>

<DIAGRAM INDICATING TRANSPORTATION TIMES OF MEDIA FED FROM FIRST FEEDER (THICK LINES) AND SECOND FEEDER (THIN LINES) IN COMPARATIVE EXAMPLE 6 (FIRST FEEDER v0>SECOND FEEDER v0, MEDIA: THICK)>

| | DEVIATION OF ARRIVAL TIMING [msec] | AMOUNT OF CORRECTION OF ARRIVAL TIMING [msec] | |
|---|---|---|---|
| EARLY | -5 | +2 | DELAY ARRIVAL TIMING |
| | -4 | +2 | |
| | -3 | +2 | |
| | -2 | +1 | |
| | -1 | 0 | |
| | 0 | 0 | |
| | +1 | 0 | |
| | +2 | -1 | |
| | +3 | -2 | |
| | +4 | -2 | ADVANCE ARRIVAL TIMING |
| LATE | +5 | -2 | |

FIG. 16

MEDIUM FEEDING MECHANISM

CROSS-REFERENCE TO RELATED APPLICATION

This application is based upon and claims the benefit of priority of the prior Japanese Patent Application No. 2020-092216 and No. 2020-092217, both filed on May 27, 2020 and the prior Japanese Patent Application No. 2021-053050 filed on Mar. 26, 2021, the entire contents of which are incorporated herein by reference.

FIELD

The aspects described herein are related to a medium feeding mechanism.

BACKGROUND

A conventional medium feeding apparatus for feeding media such as sheets to a destination apparatus such as a printing apparatus may adjust a transportation velocity such that arrival timings at which media arrive at the destination apparatus (arrival times) match reference arrival timings (reference arrival times), i.e., theoretical values.

For example, a proposed technique is one wherein an image formation apparatus measures an arrival time at which a sheet is sensed by a sheet detection sensor after starting to be fed, and changes, on the basis of the measured arrival time, the transportation velocity of the sheet for the section extending from a position downward from the sheet detection sensor to a paper stop roller (see, for example, Japanese Laid-open Patent Publication No. 2005-298168).

SUMMARY

In one aspect, a medium feeding mechanism includes a first feeder that feeds a medium, a transportation path that is coupled to the feeder and includes a bent portion, a transporter that transports the medium on the transportation path, and a transportation control unit that controls the transporter, wherein the transportation control unit adjusts a transportation velocity of the medium transported by the transporter on the basis of medium information of the medium and a transportation route shape for the medium.

The object and advantages of the present invention will be realized by the elements set forth in the claims or combinations thereof.

BRIEF DESCRIPTION OF DRAWINGS

FIG. 16 is a table indicating the relationship between deviations of timings of arrival to a paper stop sensor and corresponding correction amounts.

DESCRIPTION OF EMBODIMENTS

Figure 1:
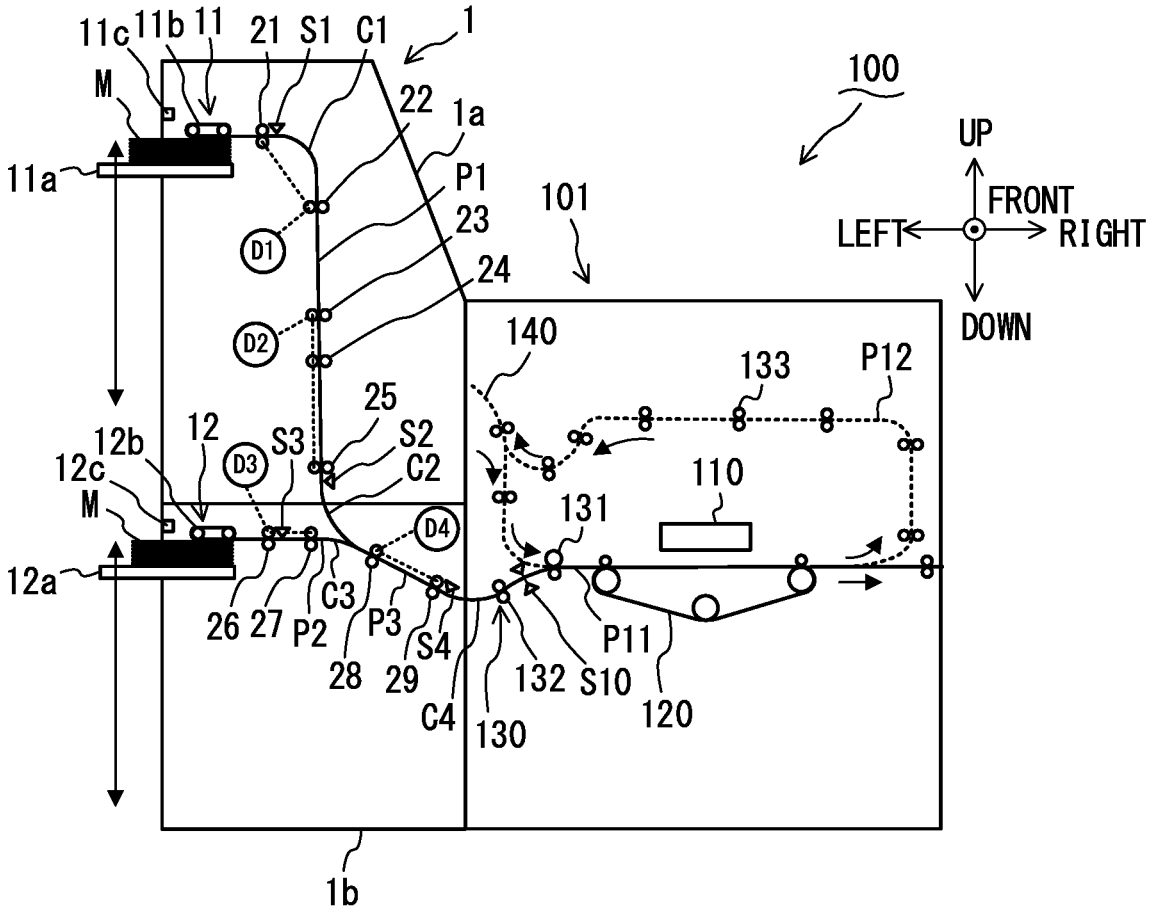
FIG. 1 illustrates the internal configuration of a printing system in one embodiment.

In the meantime, in a case where a transportation path for a medium includes a bent portion, the position in the bent portion where the medium passes varies according to the toughness of the medium. Thus, there will be differences between the lengths of paths media actually take. For example, the path length may be decreased when a tough medium such as thick paper takes the shortest path in a bent portion, and the path length may be increased when a soft medium such as thin paper travels along a guide plate on the outside in the bent portion.

Thus, when a transportation path includes a bent portion, the timing at which a medium arrives at a destination apparatus such as a printing apparatus (arrival time) may vary depending on the medium type. In the case of, for example, a printing apparatus that corrects skew of a medium by causing the medium to abut a paper-stop-roller pair, the timing at which the medium abuts the paper-stop-roller pair may vary depending on the medium type. Thus, due to a variation in the capability to correct skew of media, an image quality, i.e., a printing result, could be decreased, or a jam could occur.

The above-described technique of measuring an arrival time up to the sensing by a sheet detection sensor and changing the transportation velocity of a sheet for the section from a position downward from the sheet detection sensor to a paper-stop-roller pair can be used to make more constant the timings at which media arrive at a destination apparatus. However, the variation in arrival timing that depends on the medium type cannot be reduced.

The following describes a medium feeding medium in accordance with embodiments of the present invention by referring to the drawings.

One Embodiment

FIG. 1 illustrates the internal configuration of a printing system 100.

Figure 2:
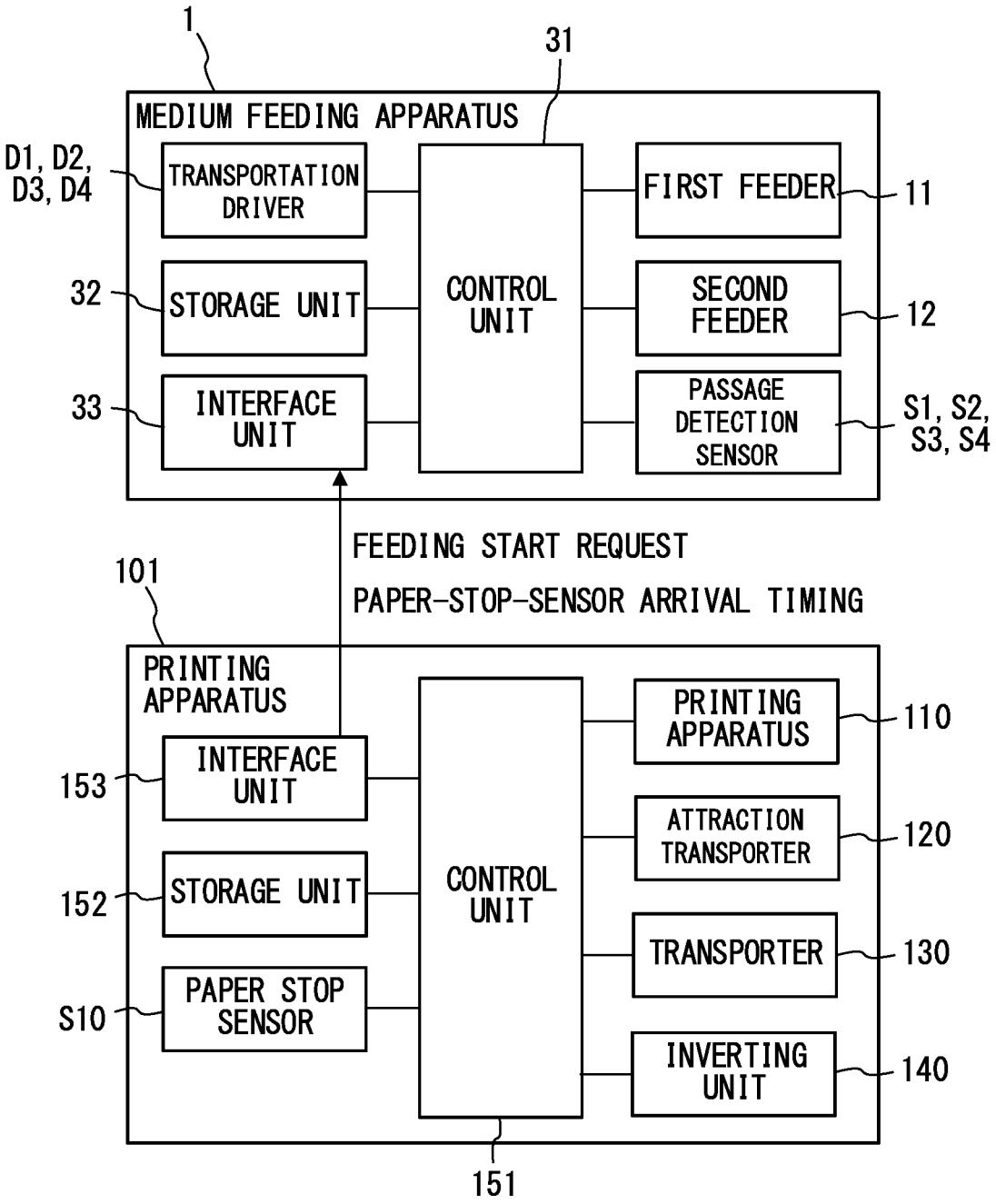
FIG. 2 illustrates the control configurations of a medium feeding apparatus and a printing apparatus in one embodiment.

FIG. 2 illustrates the control configurations of a medium feeding apparatus 1 and a printing apparatus 101.

The front-rear direction, up-down direction, and left-right direction indicated in FIG. 1 are merely directions for descriptive purposes. For example, the front-rear direction and the left-right direction may each be a horizontal direction, and the up-down direction may be a vertical direction.

The printing system 100 depicted in FIG. 1 includes the medium feeding apparatus 1 and the printing apparatus 101. As will be described hereinafter in detail, the medium feeding mechanism in the present embodiment includes the medium feeding apparatus 1 and components on a transportation route extending to a paper-stop-roller pair 131 in the printing apparatus 101 (a reception roller pair 132, a paper stop sensor S10, and a joining transportation path P3).

The medium feeding apparatus 1 feeds media M to the printing apparatus 101, i.e., an example of a destination apparatus for media M. The destination apparatus may be another apparatus such as a transportation apparatus or a post-processing apparatus. The medium feeding apparatus 1 may be integral with a destination apparatus such as the printing apparatus 101. Media M are, for example, sheets (flat paper) but may be other sheet-like media such as films.

As depicted in FIG. 1, the medium feeding apparatus 1 includes a first feeder 11, a second feeder 12, a first individual transportation path P1, a second individual transportation path P2, a joining transportation path P3, first to ninth transportation roller pairs 21-29, first to fourth transportation drivers D1-D4, a first entrance passage detection sensor S1, a first exit passage detection sensor S2, a second entrance passage detection sensor S3, and a second exit passage detection sensor S4. As depicted in FIG. 2, the medium feeding apparatus 1 also includes a control unit 31, a storage unit 32, and an interface unit 33.

The medium feeding apparatus 1 is divided into an upper stage 1*a* and a lower stage 1*b*. The first feeder 11 is disposed in the upper stage 1*a*. The second feeder 12 is disposed in the lower stage 1*b*. Thus, the first feeder 11 and the second feeder 12 are vertically arranged. The first feeder 11 and the second feeder 12 are examples of a feeder that feeds media M. A single feeder or three or more feeders may be disposed as the feeder. The direction in which the plurality of feeders are arranged may be, but is not particularly limited to, the front-rear direction or the left-right direction.

The first feeder 11 and the second feeder 12 respectively include placement mounts 11*a* and 12*a*, attraction transporters 11*b* and 12*b*, and medium thickness setting units 11*c* and 12*c*.

A plurality of media M are placed on each of the placement mounts 11*a* and 12*a*.

For example, the attraction transporters 11*b* and 12*b* may each include two pulleys and a belt covering the pulleys and may each draw out, one by one, media M attracted to the belt by air suction. The attraction transporters 11*b* and 12*b* are examples of drawing-out units that draw out media M one by one from the first feeder 11 and the second feeder 12.

The medium thickness setting units 11*c* and 12*c* are used by a user to set the thickness of media M placed on the placement mounts 11*a* and 12*a*. For example, the medium thickness setting units 11*c* and 12*c* may each include a lever, dial, or the like that can be moved to a position where an expression of "thick paper" indicating that the media M are thick paper is presented, a position where an expression of "plain paper" indicating that the media M are plain paper is presented, or a position where an expression of "thin paper" indicating that the media M are thin paper is presented. The control unit 31 (described hereinafter) obtains the thickness of media M, i.e., an example of medium information that is set using the medium thickness setting unit 11*c* or 12*c*. The medium information may be information on the material for media M. The control unit 31 may obtain a print job or medium information such as the thickness of media M that is set using an operation panel on the printing apparatus 101.

Although not illustrated, the first feeder 11 and the second feeder 12 include placement-mount lifting-and-lowering drivers such as motors (examples of an actuator) for moving up or down the placement mounts 11*a* and 12*a*, and drawing-out drivers such as motors (examples of an actuator) for rotating drive pulleys that are each one of the two pulleys of the attraction transporter 11*b* or 12*b*.

The first feeder 11 and the second feeder 12 may have disposed thereon floating-air blowout mechanisms for floating a plurality of media M placed over the placement mounts 11*a* and 12*a*, including the uppermost media M, and separation-air blowout mechanisms for blowing out separation air separating the uppermost media M from the media M thereunder.

The first individual transportation path P1 is coupled to the first feeder 11. The second individual transportation path P2 is coupled to the second feeder 12. The joining transportation path P3 join the first individual transportation path P1 and the second individual transportation path P2 together and extends to the paper-stop-roller pair 131 in the printing apparatus 101. The first individual transportation path P1 and the second individual transportation path P2 are examples of a plurality of individual transportation paths each coupled to each of a plurality of feeders (first feeder 11 and second feeder 12).

A large proportion of the first individual transportation path P1 is disposed within the upper stage 1*a* of the medium feeding apparatus 1. The second individual transportation path P2 is disposed within the lower stage 1*b* of the medium feeding apparatus 1. The first individual transportation path P1 joins the second individual transportation path P2 on a portion of the joining transportation path P3 that is disposed within the lower stage 1*b*. Accordingly, the transportation path of the medium feeding apparatus 1 includes the first individual transportation path P1, the second individual transportation path P2, and a portion of the joining transportation path P3. Note that the first individual transportation path P1 is longer in the transportation direction of media M than the second individual transportation path P2.

A medium M fed from the first feeder 11 is transported on the first individual transportation path P1 and the joining transportation path P3. Hence, the transportation route of the medium M fed from the first feeder 11 consists of the first individual transportation path P1 and the joining transportation path P3. A medium M fed from the second feeder 12 is transported on the second individual transportation path P2 and the joining transportation path P3. Hence, the transportation route of the medium M fed from the second feeder 12 consists of the second individual transportation path P2 and the joining transportation path P3.

The first individual transportation path P1 includes a first bent portion C1 provided between the first transportation roller pair 21 and the second transportation roller pair 22 and bent from the rightward direction to the downward direction for the transportation direction, and a second bent portion C2 provided between the fifth transportation roller pair 25 and the eighth transportation roller pair 28 and bent from the downward direction to the downward-right direction for the transportation direction.

The second individual transportation path P2 includes a third bent portion C3 provided between the seventh transportation roller pair 27 and the eighth transportation roller pair 28 and bent from the rightward direction to the downward-right direction for the transportation direction.

The joining transportation path P3 includes a fourth bent portion C4 spanning the medium feeding apparatus 1 and the printing apparatus 101 so as to be provided between the ninth transportation roller pair 29 and the paper-stop-roller pair 131 and bent from the downward-right direction to the upward-right direction for the transportation direction.

Since the transportation path for media M includes the first to fourth bent portions C1-C4, the positions in the first to fourth bent portions C1-C4 where the media M pass vary according to the toughness of the media M. Thus, there will be differences between the lengths of paths media M actually take.

Figure 3A:
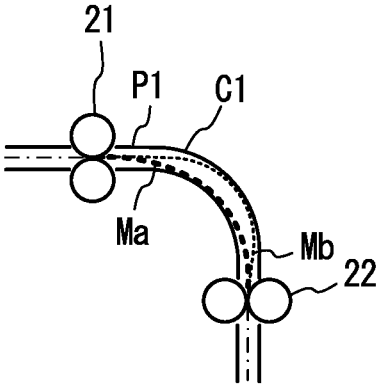
FIGS. 3A-3C are explanatory diagrams for positions where thick paper or thin paper passes, regarding a bent portion (FIG. 3A, corner angle: large), a bent portion (FIG. 3B, corner angle: medium), and a bent portion (FIG. 3C, corner angle: small)

In the case of, for example, a first bent portion C1 (corner angle: large) which is bent, as depicted in FIG. 3A, from the rightward direction to the downward direction for the transportation direction with, for example, an angle of about 90°, for the section between the first transportation roller pair 21 and the second transportation roller pair 22, tough thick paper Ma indicated by a dashed thick line will take the shortest path so that the path length will decrease, and untough thin paper Mb indicated by a dashed thin line will travel along a guide plate on the outside so that the path length will increase.

Figure 3B:
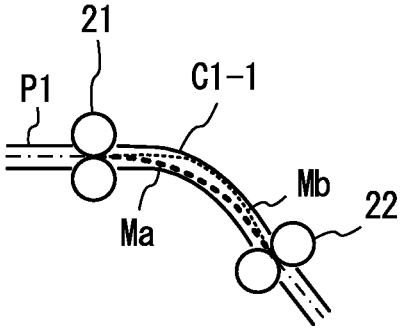

In the case of, for example, a bent portion C1-1 (corner angle: medium) which has been modified to be bent, as depicted in FIG. 3B, from the rightward direction to the downward-right direction for the transportation direction with, for example, an angle of about 45°, the difference in path length is smaller than in the first bent portion C1, but there will be a difference in path length between thick paper Ma having a long path length and thin paper Mb having a short path length.

Figure 3C:
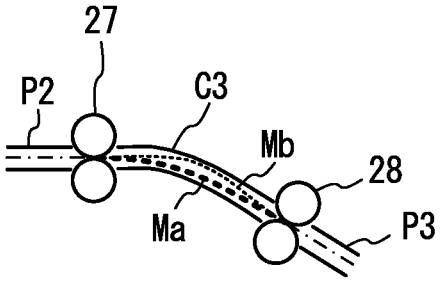

In the case of, for example, a third bent portion C3 (corner angle: small) which has been modified to be bent, as depicted in FIG. 3C, from the rightward direction to the downward-right direction for the transportation direction with, for example, an angle of about 30°, the difference in path length is smaller than in the first bent portion C1 and in the bent portion C1-1, but there will be a difference in path length between thick paper Ma having a long path length and thin paper Mb having a short path length for the section between the seventh transportation roller pair 27 and the eighth transportation roller pair 28.

As described above, the path length of a medium M in the bent portions (first to third bent portions C1-C3) varies according to the thickness (toughness). Hence, the path length of the medium M, and thus the timing of arrival at the paper-stop-roller pair 131, varies according to the thickness of the medium M and a transportation route shape on the transportation path for the medium (e.g., the degree of, or the presence/absence of, corner angles of the first to fourth bent portions C1-C4).

The first to ninth transportation roller pairs 21-29 each include a driving roller and a driven roller that are disposed facing each other, and each transport a medium M in a nipping manner.

The first to fifth transportation roller pairs 21-25 transport a medium M on the first individual transportation path P1 within the upper stage 1*a* of the medium feeding apparatus 1. The sixth and seventh transportation roller pairs 26 and 27 transport a medium M on the second individual transportation path P2 within the lower stage 1*b* of the medium feeding apparatus 1. The eighth and ninth transportation roller pairs 28 and 29 transport a medium M on a portion of the joining transportation path P3 that is located within the lower stage 1*b* of the medium feeding apparatus 1. The first to fifth transportation roller pairs 21-25 and the sixth and seventh transportation roller pairs 26 and 27 are examples of a plurality of individual transporters that transport a medium M on the first individual transportation path P1 and the second individual transportation path P2 (a plurality of individual transportation paths). The eighth and ninth transportation roller pairs 28 and 29 and the reception roller pair 132 (described hereinafter) of the printing apparatus 101 are examples of a joining transporter that transports a medium M on the joining transportation path P3. Accordingly, the medium feeding mechanism includes a transporter for transporting media M that includes a plurality of individual transporters (the first to fifth transportation roller pairs 21-25 and the sixth and seventh transportation roller pairs 26 and 27) and a joining transporter (the eighth and ninth transportation roller pairs 28 and 29 and the reception roller pair 132).

The first to fourth transportation drivers D1-D4 are motors (examples of an actuator) for rotating the driving rollers of the first to ninth transportation roller pairs 21-29. The first transportation driver D1 rotates the driving rollers of the first and second transportation roller pairs 21 and 22. The second transportation driver D2 rotates the driving rollers of the third to fifth transportation roller pairs 23-25. The third transportation driver D3 rotates the driving rollers of the sixth and seventh transportation roller pairs 26 and 27. The fourth transportation driver D4 rotates the driving rollers of the eighth and ninth transportation roller pairs 28 and 29. The first and second transportation drivers D1 and D2 and the third transportation driver D3 are examples of individual transportation drivers for driving a plurality of individual transporters (the first to fifth transportation roller pairs 21-25 and the sixth and seventh transportation roller pairs 26 and 27). The fourth transportation driver D4 and a transportation driver (not illustrated) for driving the reception roller pair 132 are examples of joining transportation drivers for driving joining drivers (the eighth and ninth transportation roller pairs 28 and 29 and the reception roller pair 132). Thus, the medium feeding mechanism is provided with a transportation driver that includes the individual transportation drivers (the first to third transportation drivers D1-D3) and the joining transportation drivers (the fourth transportation driver D4 and the transportation driver for the reception roller pair 132).

For example, the first entrance passage detection sensor S1, the first exit passage detection sensor S2, the second entrance passage detection sensor S3, and the second exit passage detection sensor S4 may be reflecting or transmitting photoelectric sensors that sense passage of a medium M.

The first entrance passage detection sensor S1 is disposed adjacent to the first transportation roller pair 21 at a position downstream from the first transportation roller pair 21 in the transportation direction. The first exit passage detection sensor S2 is disposed adjacent to the fifth transportation roller pair 25 at a position downstream from the fifth transportation roller pair 25 in the transportation direction. Thus, the first entrance passage detection sensor S1 senses passage of a medium M in the vicinity of the entrance to the first individual transportation path P1, and the first exit passage detection sensor S2 senses passage of a medium M in the vicinity of the exit from the first individual transportation path P1.

The second entrance passage detection sensor S3 is disposed adjacent to the sixth transportation roller pair 26 at a position downstream from the sixth transportation roller pair 26 in the transportation direction. The second exit passage detection sensor S4 is disposed adjacent to the ninth transportation roller pair 29 at a position downstream from the ninth transportation roller pair 29 in the transportation direction. Thus, the second entrance passage detection sensor S3 senses passage of a medium M in the vicinity of the entrance to the second individual transportation path P2, and the second exit passage detection sensor S4 senses passage of a medium M at a portion of the joining transportation path P3 in the vicinity of the exit of the medium feeding apparatus 1.

The first entrance passage detection sensor S1, the first exit passage detection sensor S2, and the second entrance passage detection sensor S3 are examples of a plurality of passage detection sensors that are disposed at a plurality of individual transportation paths (the first individual transportation path P1 and the second individual transportation path P2) and sense passage of a medium M before arrival at an arrival detection sensor (the paper stop sensor S10 described hereinafter).

The control unit 31 depicted in FIG. 2 includes a processor (e.g., central processing unit (CPU)) for functioning as an arithmetic processing apparatus for controlling the operations of the entirety of the medium feeding apparatus 1 and controls the components of the medium feeding apparatus 1. For example, the control unit 31 may be an example of a transportation control unit that controls the first to seventh transportation roller pairs 21-27 (individual transporters) and the eighth and ninth transportation roller pairs 28 and 29 (joining transporters) by using the first to fourth transportation drivers D1-D4. When the medium feeding apparatus 1 is integral with a destination apparatus such as the printing apparatus 101, the control unit of the destination apparatus (e.g., the control unit 151 (described hereinafter) of the printing apparatus 101) may function as the transportation control unit.

For example, the storage unit 32 may include a memory such as a read only memory (ROM) consisting of a read-only semiconductor memory having a predetermined control program recorded therein in advance, or a random access memory (RAM) consisting of a randomly writable/readable semiconductor memory used as a working storage region on an as-needed basis when a processor executes various control programs. When the medium feeding apparatus 1 is integral with a destination apparatus such as the printing apparatus 101, the storage unit of the destination apparatus (e.g., the storage unit 152 (described hereinafter) of the printing apparatus 101) may function as the storage unit 32.

The interface unit 33 communicates various information with external devices such as the printing apparatus 101. For example, the interface unit 33 may receive information such as a feeding start request or a paper-stop-sensor arrival timing (described hereinafter) for a medium M from the interface unit 153 of the printing apparatus 101, and the control unit 31 may control the operations of various components of the medium feeding apparatus 1 on the basis of the information.

Next, descriptions are given of the printing apparatus 101.

As depicted in FIGS. 1 and 2, the printing apparatus 101 includes a printing unit 110, an attraction transporter 120, a transporter 130, a paper stop sensor S10, a destination transportation path P11, a circulation inverting transportation path P12, an inverting unit 140, a control unit 151, a storage unit 152, and an interface unit 153. Note that FIG. 1 depicts the joining transportation path P3 and the destination transportation path P11 by using a solid line and depicts the circulation inverting transportation path P12 by using a dashed line.

For example, the printing unit 110 may include line-head-type inkjet heads (not illustrated) for various colors to be used in printing. The printing unit 110 may use a printing scheme other than the inkjet printing scheme.

As depicted in FIG. 1, the attraction transporter 120 is disposed facing the printing unit 110. The attraction transporter 120 transports a medium M by means of a transportation belt while attracting the medium M.

The transporter 130 includes: the paper-stop-roller pair 131 that corrects skew of a medium M transported toward the printing unit 110 upon the medium M abutting the paper-stop-roller pair 131; the reception roller pair 132 that transports a medium M on the joining transportation path P3 continuous from the medium feeding apparatus 1; and a plurality of transportation roller pairs 133 that transport a medium M on the destination transportation path P11 or the circulation inverting transportation path P12. The paper-stop-roller pair 131, the reception roller pair 132, and the plurality of transportation roller pairs 133 transport a medium M in a nipping manner.

The paper stop sensor S10 is disposed in the vicinity of the paper-stop-roller pair 131 at a portion of the joining transportation path P3 upstream from the paper-stop-roller pair 131 in the transportation direction. The paper stop sensor S10 is an example of an arrival detection sensor that is disposed at the joining transportation path P3 and senses an arrival timing, i.e., an example of an arrival time of a medium M. The arrival detection sensor may also be the second exit passage detection sensor S4 disposed at the portion of the joining transportation path P3 within the medium feeding apparatus 1. The medium feeding mechanism in the present embodiment includes, as described above, the medium feeding apparatus 1 and the components of the transportation route leading to the paper-stop-roller pair 131 of the printing apparatus 101, and thus the reception roller pair 132 and the paper-stop-roller pair S10 can be said to be portions of the medium feeding mechanism.

The destination transportation path P11 is coupled to the joining transportation path P3 continuous from the medium feeding apparatus 1 and extends downstream in the transportation direction with reference the paper-stop-roller pair 131. When the printing system 100 depicted in FIG. 1 has disposed therewithin another printing apparatus and a medium ejection apparatus positioned downstream in the transportation direction from the printing apparatus 101, the destination transportation path P11 will be coupled to the transportation paths within these apparatuses.

A medium M with one surface having undergone printing by the printing unit 110 is transported to the circulation inverting transportation path P12 so as to have the other surface thereof undergo printing.

The inverting unit 140 includes an inverting path for inverting the front and back sides of a medium M transported on the circulation inverting transportation path R12, and a switchback roller pair.

The control unit 151 depicted in FIG. 2 includes a processor (e.g., CPU) that functions as an arithmetic processing apparatus for controlling the operations of the entirety of the printing apparatus 101, and controls the components of the printing apparatus 101.

For example, the storage unit 152 may include a memory such as a ROM consisting of a read-only semiconductor memory having a predetermined control program recorded therein in advance, or a RAM consisting of a randomly writable/readable semiconductor memory used as a working storage region on an as-needed basis when a processor executes various control programs.

The interface unit 153 communicates various information with the medium feeding apparatus 1 and external devices such as user terminals that transmit print data. For example, as described above, the interface unit 153 may send information such as a feeding start request or a paper-stop-sensor arrival timing (described hereinafter) for a medium M to the interface unit 33 of the medium feeding apparatus 1.

The following describes operations of the medium feeding apparatus 1 while omitting, as appropriate, descriptions of matters that have already been given hereinbefore.

First, upon the interface unit 33 receiving a feeding start request for media M from the printing apparatus 101 (interface unit 153), the control unit 31 illustrated in FIG. 2 controls the first feeder 11 and the second feeder 12 depicted in FIG. 1 such that media M are fed in an alternating pattern from the first feeder 11 and the second feeder 12 or media M are fed from only either thereof.

When a medium M is fed from the first feeder 11, the control unit 31 controls the first to fifth transportation roller pairs 21-25 by using the first transportation driver D1 and the second transportation driver D2 so as to transport the medium M fed from the first feeder 11 on the first individual transportation path P1. Passage of the medium M being transported on the first individual transportation path P1 is sensed by the first entrance passage detection sensor S1 and the first exit passage detection sensor S2.

When a medium M is fed from the second feeder 12, the control unit 31 controls the sixth and seventh transportation roller pairs 26 and 27 by using the third transportation driver D3 so as to transport the medium M fed from the second feeder 12 on the second individual transportation path P2. Passage of the medium M being transported on the second individual transportation path P2 is sensed by the second entrance passage detection sensor S3.

The control unit 31 also controls the eighth and ninth transportation roller pairs 28 and 29 by using the fourth transportation driver D4 so as to transport, on the joining transportation path P3, the medium M transported from the first individual transportation path P1 or the second individual transportation path P2. Passage of the medium M being transported on the joining transportation path P3 is sensed by the second exit passage detection sensor S4.

Accordingly, the medium M is fed to the printing apparatus 101 by being transported on the joining transportation path P3 continuous from the medium feeding apparatus 1, abuts the paper-stop-roller pair 131 and thus has skew thereof corrected, and then undergoes printing by the printing unit 110. Passage (arrival) of the medium M being transported on the portion of the joining transportation path P3 in the printing apparatus 101 is sensed by the paper stop sensor S10. The timing of arrival of the medium M at the paper stop sensor S10 is sent from the printing apparatus 101 (interface unit 153) to the medium feeding apparatus 1 (interface unit 33).

The following describes a process for adjusting the transportation velocity of a medium M within the medium feeding apparatus 1.

Figure 4:
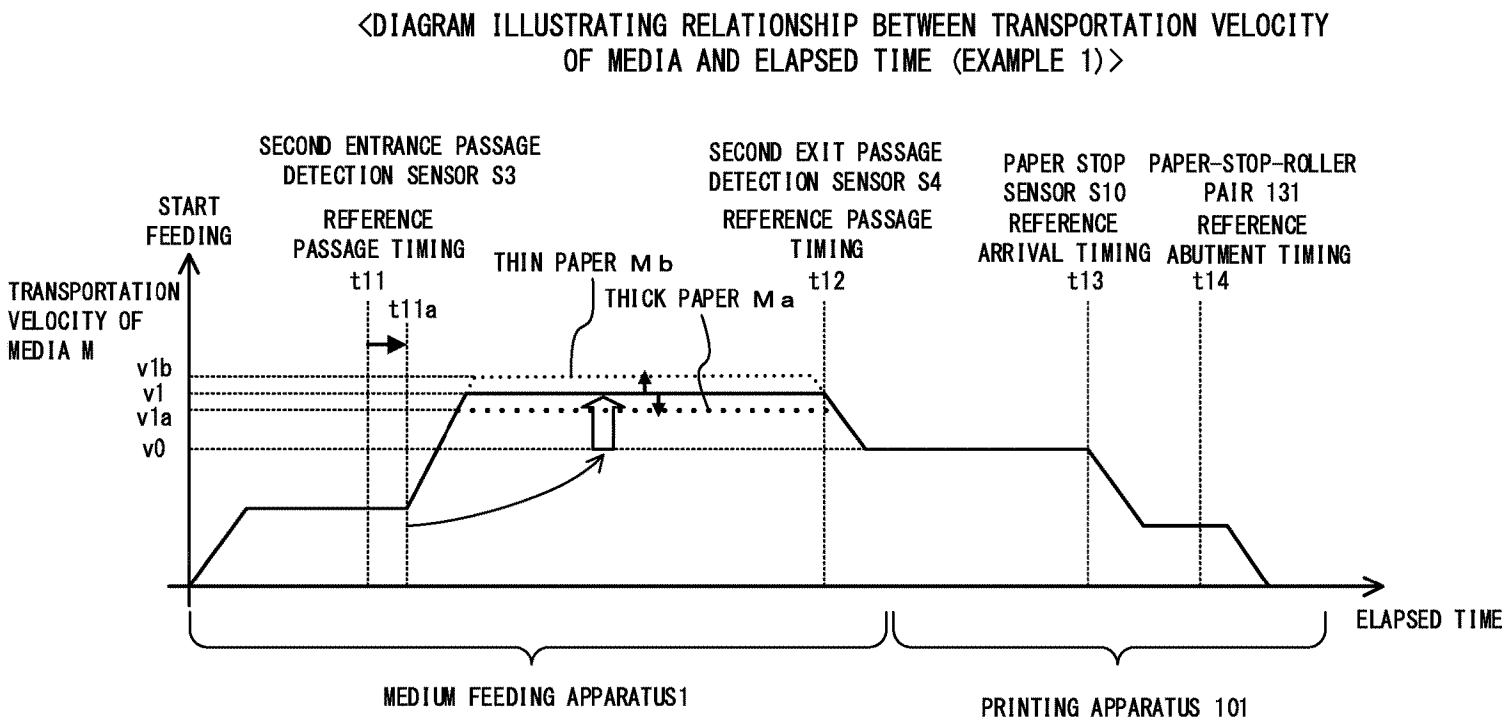
FIG. 4 illustrates a relationship between the transportation velocity of media and an elapsed time for a medium feeding mechanism in one embodiment (example 1)
Figure 5:
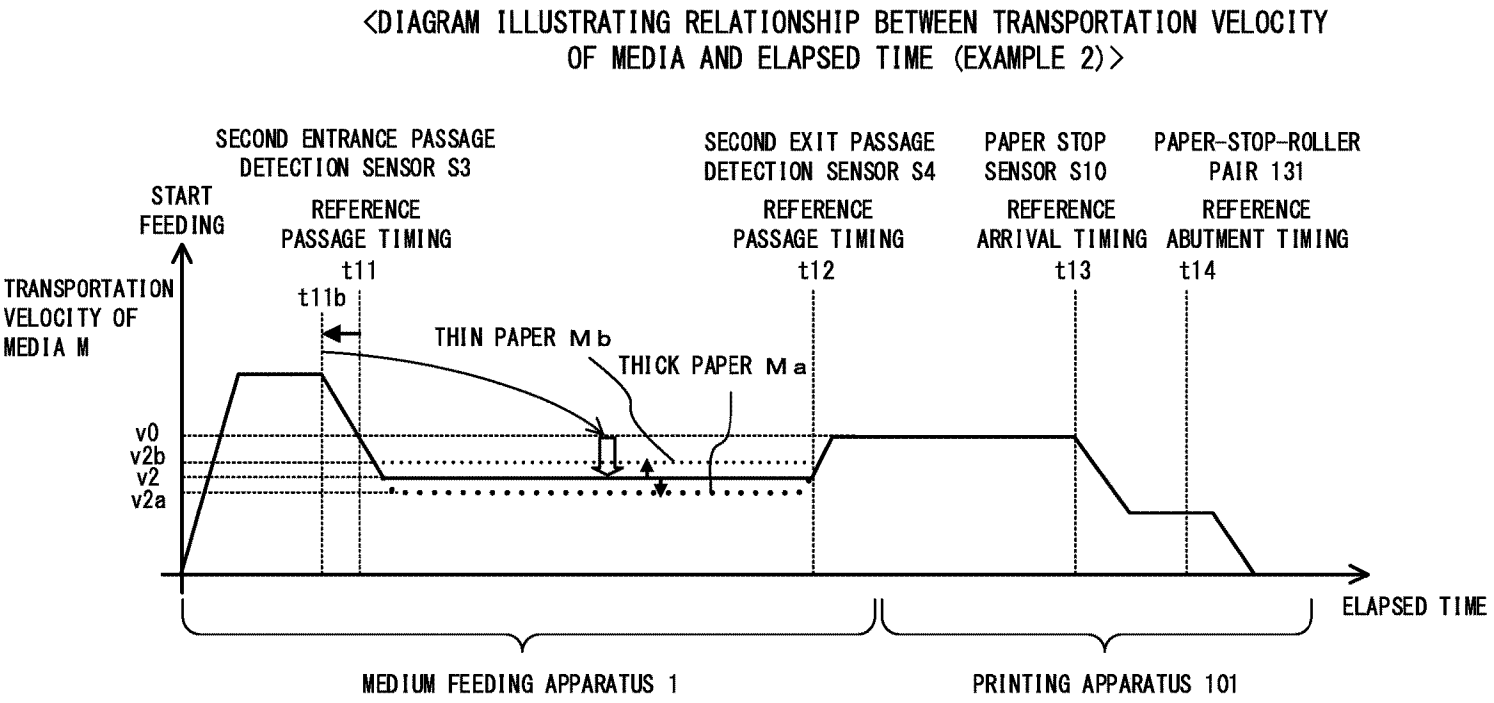
FIG. 5 illustrates a relationship between the transportation velocity of media and an elapsed time for a medium feeding mechanism in one embodiment (example 2)
Figure 6:
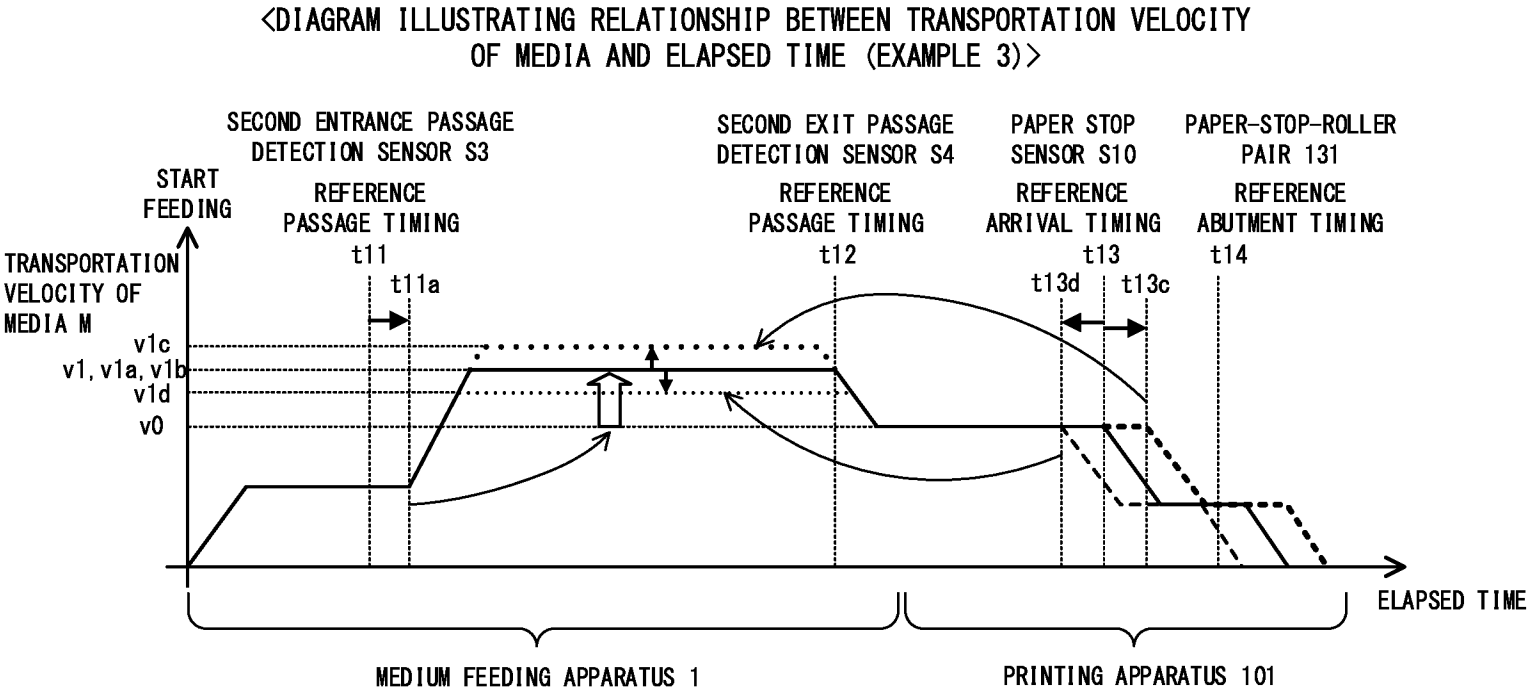
FIG. 6 illustrates a relationship between the transportation velocity of media and an elapsed time for a medium feeding mechanism in one embodiment (example 3)
Figure 7:
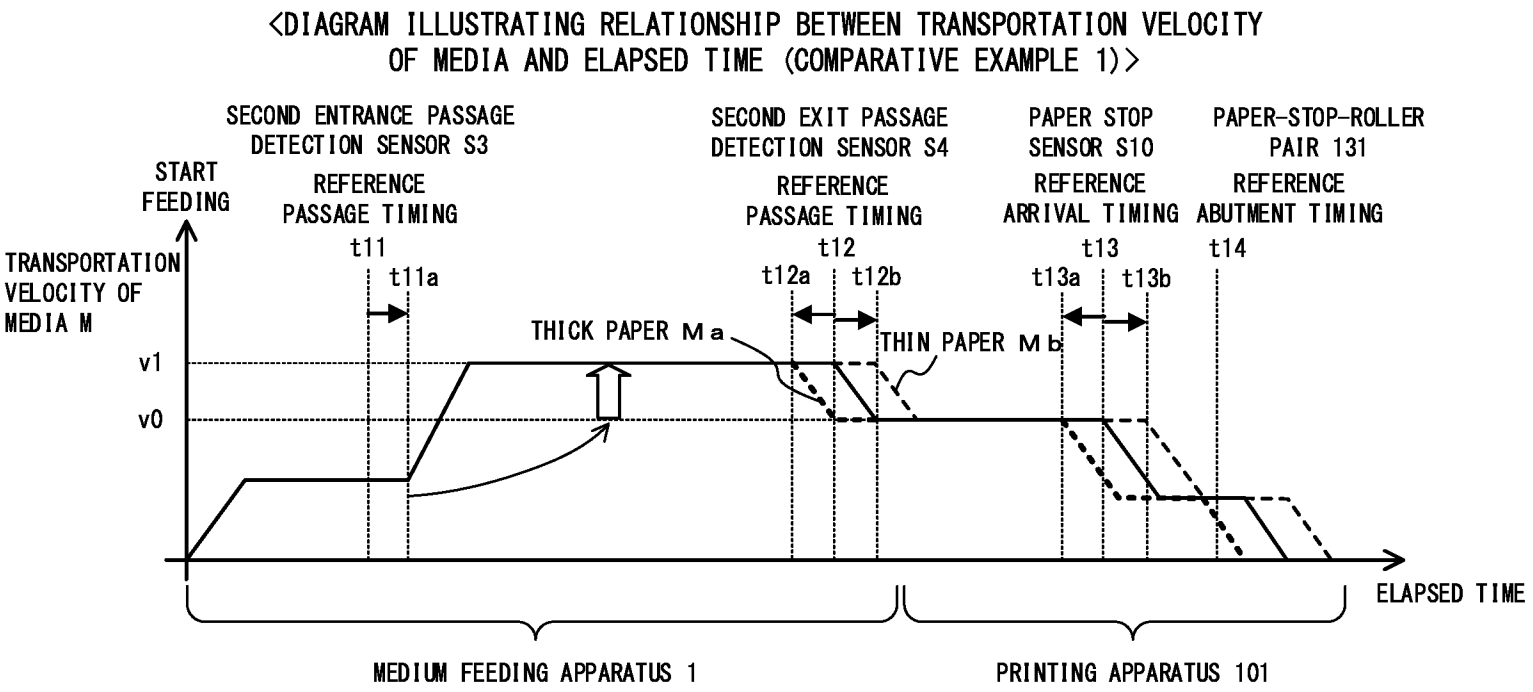
FIG. 7 illustrates a relationship between the transportation velocity of media and an elapsed time for a medium feeding mechanism in comparative example 1.
Figure 8:
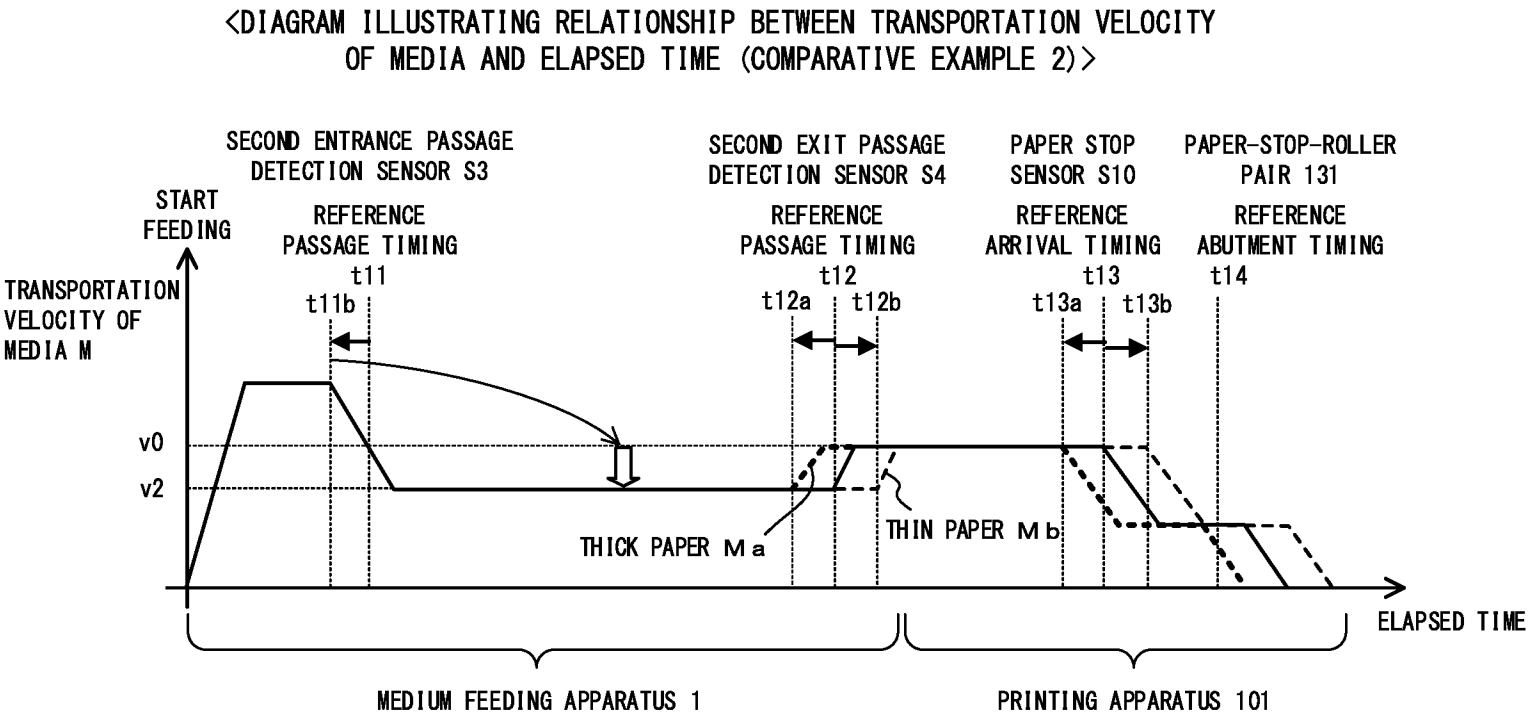
FIG. 8 illustrates a relationship between the transportation velocity of media and an elapsed time for a medium feeding mechanism in comparative example 2.

FIGS. 4-6 illustrate a relationship between the transportation velocity of media M and an elapsed time for the medium feeding mechanism in the present embodiment. FIGS. 7 and 8 illustrate a relationship between the transportation velocity of media M and an elapsed time for medium feeding mechanisms in comparative examples 1 and 2. FIGS. 4-8 indicate examples of situations in which media M are fed from the second feeder 12.

First, when the second feeder 12 has started to feed a medium M, the medium M is, as indicated in FIG. 4, gradually accelerated by the attraction transporter 12*b* and then transported to the second individual transportation path P2 at a constant velocity. Upon the medium M being transported to the second entrance passage detection sensor S3 (time t11*a*), the control unit 31 controls the sixth and seventh transportation roller pairs 26 and 27 at the second individual transportation path P2 and the eighth and ninth transportation roller pairs 28 and 29 at the joining transportation path P3 so as to transport the medium M at a transportation velocity v1.

A passage timing (time t11*a*) at which the medium M passes the second entrance passage detection sensor S3, i.e., an example of the passage time, follows a reference passage timing (time t11), i.e., a reference passage time, which is a theoretical value determined in advance, due to a low transportation rate resulting from strong slippage between the medium M and the attraction transporter 12*b*. Thus, in order to make up for the delay of the medium M, as depicted in FIG. 7 (comparative example 1), the control unit 31 determines, for the section between the second entrance passage detection sensor S3 and the second exit passage detection sensor S4 (the second individual transportation path P2 and the joining transportation path P3), a transportation velocity v1 that is higher than a transportation velocity v0 for the section between the second exit passage detection sensor S4 and the paper stop sensor S10. The passage time, an example of which is the passage timing, and the arrival time, an example of which is the arrival timing (described hereinafter), are not limited to the respective moments of passage timing and arrival timing and include an approximation error range. For example, the control unit 31 may obtain, as the passage time and the arrival time, approximate timings by rounding off or down timings sensed by the second entrance passage detection sensor S3 and the paper stop sensor S10 to round numbers.

As described above, the second individual transportation path P2 coupled to the second feeder 12 includes the third bent portion C3, and the joining transportation path P3 of the medium feeding apparatus 1 and the printing apparatus 101 include the fourth bent portion C4. Thus, when being transported on the second individual transportation path P2 and the joining transportation path P3, a medium M consisting of thick paper Ma will take a shorter path than a medium M consisting of thin paper Mb.

Accordingly, the thick paper Ma, which is indicated using thick dashed lines in FIG. 7, is sensed by the second exit passage detection sensor S4 at a passage timing (time t12*a*), which precedes a reference passage timing (time t12), i.e., a theoretical value determined in advance. The thick paper Ma also arrives at the paper stop sensor S10 at an arrival timing (time t13*a*), i.e., an arrival time, which precedes a reference arrival timing (time t13), i.e., a reference arrival time that is a theoretical value determined in advance. Furthermore, the thick paper Ma abuts the paper-stop-roller pair 131 at an abutment timing, i.e., an example of an abutment time, which precedes a reference abutment timing (time t14), i.e., an example of a reference abutment time.

The thin paper Ma, which is indicated using thin dashed lines in FIG. 7, is sensed by the second exit passage detection sensor S4 at a passage timing (time t12*b*), which follows the reference passage timing (time t12). The thin paper Mb arrives at the paper stop sensor S10 at an arrival timing (time t13*b*), which follows the reference arrival timing (time t13). Furthermore, the thin paper Mb abuts the paper-stop-roller pair 131 at an abutment timing which follows the reference abutment timing (time t14).

The thick paper Ma and the thin paper Mb having a variation, as described above, in timing of abutting the paper-stop-roller pair 131 could lead to a variation in the capability to correct skew of the media M (a variation in the amount of correction of skew that could be caused by the difference in correction period), thereby decreasing the image quality, i.e., a printing result, or causing a jam.

Accordingly, for a medium M consisting of thick paper Ma, the control unit 31 makes an adjustment such that, as indicated by a thick dotted line in FIG. 4, the transportation velocity v1 is decreased to the transportation velocity v1*a* for the section between the second entrance passage detection sensor S3 and the second exit passage detection sensor S4 (the second individual transportation path P2 and the joining transportation path P3). For example, the degree to which the control unit 31 decreases the transportation velocity v1 to the transportation velocity v1*a* may be determined in advance on the basis of a measurement result from an experiment in which the deviations of the passage timings for the second exit passage detection sensor S4 and the paper stop sensor S10 from the reference passage timings are measured for a medium M consisting of plain paper and for a medium M consisting of thick paper Ma.

Accordingly, for a medium M consisting of thin paper Mb, the control unit 31 makes an adjustment such that, as indicated by a thin dotted line in FIG. 4, the transportation velocity v1 is increased to the transportation velocity v1*b* for the section between the second entrance passage detection sensor S3 and the second exit passage detection sensor S4 (the second individual transportation path P2 and the joining transportation path P3). For example, the degree to which the control unit 31 increases the transportation velocity v1 to the transportation velocity v1*b* may be determined in advance by measuring, in an experiment, the deviations of the passage timings for the second exit passage detection sensor S4 and the paper stop sensor S10 for a medium M consisting of plain paper and for a medium M consisting of thin paper Mb.

Upon the medium M being transported to the second exit passage detection sensor S4 (time t12), the control unit 31 controls the eighth and ninth transportation roller pairs 28 and 29 at the joining transportation path P3 so as to transport the medium M at the transportation velocity v0. The reception roller pair 132 of the printing apparatus 101 transports the medium M at the transportation velocity v0, as with the eighth and ninth transportation roller pairs 28 and 29.

Accordingly, passage (arrival) of the medium M is sensed by the paper stop sensor S10 (time t13), and the medium M abuts the paper-stop-roller pair 131 at a constant velocity (time t14) after the transportation velocity of the medium M is decreased by the transporter 130 so as to reduce collision noise that could be generated when colliding with the paper-stop-roller pair 131. Then, the reception roller pair 132 stops the transportation of the medium M. In the meantime, the reception roller pair 132 does not stop the transportation of the medium M when the medium M abuts the paper-stop-roller pair 131 (time t14), so as to correct skew by loosening the medium M while the medium M is being slightly transported after the abutting.

When a medium M and the attraction transporter 12*b* have weak slippage therebetween and thus the transportation rate is high, the passage timing at which the medium M passes the second entrance passage detection sensor S3 (time t11*b*) could precede, as depicted in FIG. 5, the reference passage timing (time t11), i.e., a theoretical value determined in advance. In this case, as depicted in FIG. 8 (comparative example 2), the control unit 31 determines, for the section between the second entrance passage detection sensor S3 and the second exit passage detection sensor S4 (the second individual transportation path P2 and the joining transportation path P3), a transportation velocity v2 that is lower than the transportation velocity v0 for the section between the second exit passage detection sensor S4 and the paper stop sensor S10. The deviation of the passage timing at which a medium M passes the second entrance passage detection sensor S3 (time t11*a* or t11*b*) from the reference passage timing (time t11) may occur not only when an uppermost medium M floated by floating air and then separated from a medium M thereunder by separation air is attraction-transported by the attraction transporter 11*b* or 12*b* but also may occur due to friction between a handling plate and an upper most medium M when separating the uppermost medium M from a medium M thereunder by using the handling plate.

As described above, the thick paper Ma indicated using thick dashed lines in FIG. 8 is sensed by the second exit passage detection sensor S4 at a passage timing (time t12*a*) preceding the reference passage timing (time t12), and arrives at the paper stop sensor S10 at an arrival timing (time t13*a*) preceding the reference arrival timing (time t13). The thin paper Mb indicated using thin dashed lines in FIG. 8 is sensed by the second exit passage detection sensor S4 at a passage timing (time t12*b*) following the reference passage timing (time t12), and arrives at the paper stop sensor S10 at an arrival timing (time t13*b*) following the reference arrival timing (time t13).

Also in the example in FIG. 5, accordingly, for a medium M consisting of thick paper Ma, the control unit 31 makes an adjustment such that, as indicated by a thick dotted line, the transportation velocity v2 is decreased to the transportation velocity v2*a* for the section between the second entrance passage detection sensor S3 and the second exit passage detection sensor S4 (the second individual transportation path P2 and the joining transportation path P3). For a medium M consisting of thin paper Mb, the control unit 31 makes an adjustment such that, as indicated by a thin dotted line in FIG. 5, the transportation velocity v2 is increased to the transportation velocity v2*b* for the section between the second entrance passage detection sensor S3 and the second exit passage detection sensor S4 (the second individual transportation path P2 and the joining transportation path P3).

Afterward, as in the example depicted in FIG. 4, upon the medium M being transported to the second exit passage detection sensor S4 (time t12), the control unit 31 controls the eighth and ninth transportation roller pairs 28 and 29 at the joining transportation path P3 so as to transport the medium M at the transportation velocity v0. The reception roller pair 132 of the printing apparatus 101 transports the medium M at the transportation velocity v0, as with the eighth and ninth transportation roller pairs 28 and 29.

Accordingly, passage (arrival) of the medium M is sensed by the paper stop sensor S10 (time t13), and the medium M abuts the paper-stop-roller pair 131 at a constant velocity (time t14) after the transportation velocity of the medium M is decreased by the reception roller pair 132 so as to reduce collision noise that could be generated when colliding with the paper-stop-roller pair 131. Then, the reception roller pair 132 stops the transportation of the medium M.

FIGS. 4 and 5 (and FIGS. 7 and 8 indicating comparative examples) depict examples in which media M are fed from the second feeder 12. However, when media M are fed from the first feeder 11, the same processing may be performed with the time t11 defined as a reference passage timing for the first entrance passage detection sensor S1, instead of as the reference passage timing for the second entrance passage detection sensor S3. However, the first individual transportation path P1 coupled to the first feeder 11 includes the second bent portion C2 and the first bent portion C1, which has a larger corner angle than the third bent portion C3 of the second individual transportation path P2. Hence, the difference between the length of a path taken by a medium M consisting of thick paper Ma when being transported on the first individual transportation path P1 and the length of a path taken by a medium M consisting of thin paper Mb when being transported on the first individual transportation path P1 will be larger than the difference between the length of a path taken by a medium M consisting of thick paper Ma when being transported on the second individual transportation path P2 and the length of a path taken by a medium M consisting of thin paper Mb when being transported on the second individual transportation path P2. Thus, the control unit 31 makes an adjustment such that the transportation velocity of a medium M consisting of thick paper Ma fed from the first feeder 11 is decreased and the transportation velocity of a medium M consisting of thin paper Mb fed from the first feeder 11 is increased, i.e., an adjustment different from the adjustment of the transportation velocities of media M fed from the second feeder 12. If the transportation paths coupled to the first feeder 11 or the second feeder 12 (the first individual transportation path P1 and the joining transportation path P3 or the second individual transportation path P2 and the joining transportation path P3) include no bent portions (the first to fourth bent portions C1-C4), the adjustment of the transportation velocity of media M being transported through a transportation route without a bent portion may be omitted because the above-described difference in path length associated with the thicknesses of media M will not be made.

As described above, the control unit 31 adjusts the transportation velocities v1 and v2 of media M on the basis of the thickness of the media M, i.e., an example of medium information, and the transportation route shape for the media M. However, as depicted in FIG. 6, an arrival timing obtained by the control unit 31, i.e., a sensing result provided by the paper stop sensor S10, could deviate from the reference arrival timing determined in advance (time t13). The control unit 31 may start to measure an arrival timing by using a timer at a timing at which a feeding start request for a medium M is received from the printing apparatus 101 or at which a feeding operation is started.

When the timing of arrival at the paper stop sensor S10 is, as indicated using a thick dashed line in FIG. 6, time t13*c* following time t13, the control unit 13 controls the sixth to ninth transportation roller pairs 26-29 such that the transportation velocity v1, v1*a*, or v1*b* of a following medium M for the section between the second entrance passage detection sensor S3 and the second exit passage detection sensor S4 (the second individual transportation path P2 and the joining transportation path P3) is increased to a transportation velocity v1*c* indicated using a thick dotted line (each of the transportation velocities v1, v1*a*, and v1*b* is increased to a different velocity). Since the transportation velocity v1, v1*a*, or v1*b* varies as described above according to the timing of passing the second entrance passage detection sensor S3, the velocity of a preceding medium M is not necessarily the same as that of a following medium M. When a following medium M passes the second entrance passage detection sensor S3 at a passage timing (time t11*b*) preceding, as depicted in FIG. 5, the reference passage timing determined in advance (time t11), the control unit 13 may control the sixth to ninth transportation roller pairs 26-29 so as to increase the transportation velocity v2, v2*a*, or v2*b*.

When the arrival timing is, as indicated using a thin dashed line in FIG. 6, time t13*d* preceding the reference arrival timing (time t13), the control unit 13 controls the sixth to ninth transportation roller pairs 26-29 such that the transportation velocity v1, v1*a*, or v1*b* of a following medium M for the section between the second entrance passage detection sensor S3 and the second exit passage detection sensor S4 (the second individual transportation path P2 and the joining transportation path P3) is decreased to a transportation velocity v1*d* indicated using a thin dotted line (each of the transportation velocities v1, v1*a*, and v1*b* is decreased to a different velocity).

For example, when media M are successively fed only from the second feeder 12, the following medium M may be a medium two media after the preceding medium M with the arrival timing (time t13*c*, t13*d*) deviating from the reference arrival timing (time t13). However, the following medium M may be a medium M transported next to the preceding medium M having the deviation. When the following medium M has already been fed from the second feeder 12 and transported on the second individual transportation path P2, the transportation velocity of the following medium M may be adjusted while being transported on the second individual transportation path P2. For example, when media M are fed in an alternating pattern from the first feeder 11 and the second feeder 12, the following medium M may be a medium M fed from the second feeder 12 next to the preceding medium M having the deviation.

On the basis of at least either the length of media M in the transportation direction or the transportation velocity thereof and the length of the second individual transportation path P2 in the transportation direction, the control unit 31 may make an adjustment as to how many media M are to be transported before the following medium M is transported. The length of the second individual transportation path P2 in the transportation direction is different from that of the first individual transportation path P1. Thus, for each of the second individual transportation path P2, to which media M are fed from the second feeder 12, and the first individual transportation path P1, to which media M are fed from the first feeder 11, an adjustment may be made as to how many media M are to be transported before a following medium M is transported.

As described above, the control unit 31 uses the deviation of the arrival timing at which a preceding medium M arrives at the paper stop sensor S10 (time t13*c* or t13*d*) from the reference arrival timing (time t13), as feedback for the transportation velocity of the following medium M. Hence, the arrival timing at which the following medium M arrives at the paper stop sensor S10 is brought close to the reference arrival timing (time t13), and thus the abutment timing at which the following medium M abuts the paper-stop-roller pair 131 is brought close to the reference abutment timing (time t14). Accordingly, variations in the amount of correction of skew (correction period) between media M can be reduced.

In the example depicted in FIG. 6, on the basis of the deviation between the timing of arrival at the paper stop sensor S10 (time t13*c* or t13*d*) and the reference arrival timing (time t13), the control unit 31 determines a transportation velocity for a following medium M for the section between the second entrance passage detection sensor S3 and the second exit passage detection sensor S4 (the second individual transportation path P2 and the joining transportation path P3). However, the transportation velocity for the following medium M for the section between the second entrance passage detection sensor S3 and the second exit passage detection sensor S4 (the second individual transportation path P2 and the joining transportation path P3) may be determined on the basis of the deviation between the timing of arrival at the second exit passage detection sensor S4 and the reference arrival timing (time t12). Thus, the control unit 31 may obtain arrival timings of media M, i.e., sensing results provided by the second exit passage detection sensor S4 (an example of the arrival detection sensor) disposed at the joining transportation path P3.

In the meantime, the control unit 31 makes an adjustment such that the transportation velocity v1 or v2 of a following medium M for the section between the second entrance passage detection sensor S3 and the second exit passage detection sensor S4 (the second individual transportation path P2 and the joining transportation path P3), not for the section between the second exit passage detection sensor S4 and the paper stop sensor S10 (the joining transportation path P3 and the destination transportation path P11), becomes the transportation velocity v1*a*, v1*b*, v2*a*, or v2*b*, or such that the transportation velocity v1, v1*a*, or v1*b* of the following medium M for that section becomes the transportation velocity v1*c* or v1*d*, so that the medium feeding apparatus 1 alone can complete the adjustment of the transportation velocities. If the medium feeding apparatus 1 and the printing apparatus 101 both adjust transportation velocities, a medium M could be pulled toward the printing apparatus 101 or become loose due to inequality between the transportation velocity resulting from the eighth and ninth transportation roller pairs 28 and 29 of the medium feeding apparatus 1 and the transportation velocity resulting from the reception roller pair 132 of the printing apparatus 101. The inequality between the transportation velocities occurs because the medium feeding apparatus 1 and the printing apparatus 101 have a difference therebetween in terms of the result of measurement of the timing of arrival of a medium M at the paper stop sensor S10, due to the limitation of communication between the interface unit 33 of the medium feeding apparatus 1 and the interface unit 153 of the printing apparatus 101 (communication between substrates) or the limitation of measurement accuracy of firmware. For example, a difference of 1 [msec] may provide a difference in transportation velocity of about 20 [mm/s].

Unlike in the above descriptions, the transportation velocity of a preceding medium M for the section between the paper stop sensor S10 and the paper-stop-roller pair 131 may be adjusted on the basis of the arrival timing at which the preceding medium M arrives at the paper stop sensor S10, so as to make the timings of abutting the paper-stop-roller pair 131 more constant. In this case, however, the transportation velocities upon abutting the paper-stop-roller pair 131 will not be constant, and thus there tends to be variations in amount of correction of skew.

In the meantime, when a medium M is transported to abut the paper-stop-roller pair 131 at an abutment timing following the reference abutment timing, the following medium M will also, as a general rule, be transported to abut the paper-stop-roller pair 131 at an abutment timing following the reference abutment timing.

Figure 15:
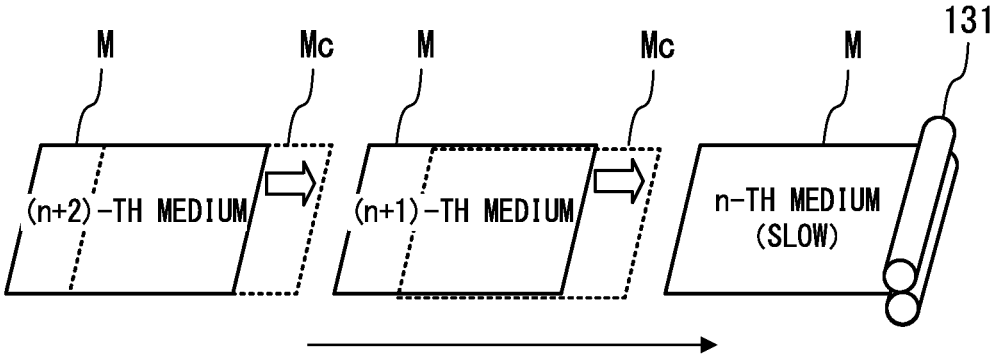
FIG. 15 is an explanatory diagram for the positional relationship between media after correction of a transportation velocity.

FIG. 15 is an explanatory diagram for the positional relationship between media Mc after correction of a transportation velocity.

FIG. 16 is a table indicating the relationship between deviations of timings of arrival to the paper stop sensor S10 and corresponding correction amounts.

As indicated in FIG. 15, when an n-th medium M is transported to abut the paper-stop-roller pair 131 at an abutment timing following the reference abutment timing, an (n+1)-th medium M and an (n+2)-th medium M will also, as a general rule, be transported to abut the paper-stop-roller pair 131 at abutment timings following the reference abutment timing.

However, for example, on the basis of delay of the arrival timing at which the preceding medium M transported prior to the n-th medium M arrives at the paper stop sensor S10 (see time t13*c* indicated in FIG. 6), the transportation velocity v1, v1*a*, or v1*b* of the (n+1)-th medium M for the section between the second entrance passage detection sensor S3 and the second exit passage detection sensor S4 depicted in FIG. 1 (the second individual transportation path P2 and the joining transportation path P3) may be adjusted to be increased to the transportation velocity v1*c*, thereby bringing the (n+1)-th medium Mc after the correction close to the n-th medium M. Thus, for example, a jam could occur due to the (n+1)-th medium M colliding with the n-th medium M abutting the paper-stop-roller pair 131, or the time required to change the rotational velocity of the sixth and seventh transportation roller pairs 26 and 27 at the second individual transportation path P2 or that of the eighth and ninth transportation roller pairs 28 and 29 at the joining transportation path P3 may be incapable of being ensured by means of the space between the n-th medium M and the (n+1)-th medium M.

Accordingly, especially when the media M is fed at short intervals (the spaces between a plurality of media M are short) or the transportation velocity is high, the control unit 31 may determine the transportation velocity for a following medium M such that the deviation of the arrival timing at which a medium M arrives at the paper stop sensor S10 (time t13*c*, t13*d*) from the reference arrival timing (time t13) is not completely eliminated for the following medium M but is partly eliminated.

For example, when the arrival timing precedes the reference arrival timing by 5 [msec], 4 [msec], or 3 [msec], the control unit 31 may refer to the table depicted in FIG. 16, which is stored in the storage unit 32, and may correct the transportation velocity of the following medium M so as to delay the arrival timing thereof by 2 [msec], not 5 [msec], 4 [msec], or 3 [msec]. When the arrival timing precedes the reference arrival timing by 2 [msec], the control unit 31 may correct the transportation velocity of the following medium M so as to delay the arrival timing thereof by 1 [msec], not 2 [msec].

By contrast, when the arrival timing is delayed by 5 [msec], 4 [msec], or 3 [msec] with reference to the reference arrival timing, the control unit 31 may correct the transportation velocity of the following medium M so as to advance the arrival timing thereof by 2 [msec]. When the arrival timing is delayed by 2 [msec] with reference to the reference arrival timing, the control unit 31 may correct the transportation velocity of the following medium M so as to advance the arrival timing thereof by 1 [msec].

When the arrival timing precedes the reference arrival timing by 1 [msec], is delayed by 1 [msec] with reference to the reference arrival timing, or is not deviated from the reference arrival timing (0 [msec]), the control unit 31 does not correct the transportation velocity of the following medium M. In particular, the control unit 31 controls the sixth to ninth transportation roller pairs 26-29 so as to transport the following medium M under the same conditions as the preceding medium M.

The amounts of correction of arrival timing indicated in FIG. 16 may be determined in accordance with the transportation velocity of media M and the intervals at which the media M are fed. Accordingly, the storage unit 32 may store a plurality of types of the tables depicted in FIG. 16 in accordance with the transportation velocity of media M or the intervals at which the media M are fed (and the length (size) of the media M in the transportation direction, the transportation route shape (the first individual transportation path or the second individual transportation path P2), or the like).

For example, as the intervals at which media M are fed become shorter or as the transportation velocity becomes higher, the amount of correction of arrival timing may be made sufficiently smaller with respect to the deviation of the arrival timing. As the intervals at which media M are fed become longer or as the transportation velocity becomes lower, the reduction in the amount of correction of arrival timing, i.e., an example of the arrival time correction amount, may be decreased or eliminated with respect to the deviation of the arrival timing.

The control unit 31 may calculate and determine the amount of correction of arrival timing on the basis of the deviation of the timing of arrival at the paper stop sensor S10 from the reference arrival timing, the intervals at which media M are fed, the transportation velocity of the media M, the length of the media M in the transportation direction, as well as the thickness of the media M, i.e., an example of the medium information, and the transportation route shape for the media M.

The control unit 31 may obtain a setting of an adjustment value input for the transportation velocity by a user using an operation panel on the printing apparatus 101, and adjust the transportation velocity on the basis of this setting. In this way, the individual differences between medium feeding apparatuses 1 can be corrected.

In the embodiment described above, the medium feeding mechanism includes: the first feeder 11 and the second feeder 12, i.e., examples of the feeder, which feed media M; the first individual transportation path P1, the second individual transportation path P2, and the joining transportation path P3, i.e., examples of the transportation path, which are coupled to the first feeder 11 and the second feeder 12 and include bent portions (first to fourth bent portions C1-C4); the first to ninth transportation roller pairs 21-29 and the reception roller pair 132, i.e., examples of the transporter, which transport the media M on the transportation paths; and the control unit 31, i.e., an example of the transportation control unit, which controls the first to ninth transportation roller pairs 21-29. The control unit 31 adjusts the transportation velocity of media M on the first to ninth transportation roller pairs 21-29 on the basis of the thickness of the media M, i.e., an example of the medium information, and the transportation route shape for the media M.

In the meantime, in accordance with the types of media M (e.g., difference in toughness resulting from the difference in thickness), the media M will pass different positions within the first to third bent portions C1-C3 of the first individual transportation path P1 and the second individual transportation path P2 and the fourth bent portion C4 of the joining transportation path P3, and thus there will be differences between the lengths of routes the media M will actually take. In this regard, the control unit 31 in the present embodiment can adjust the transportation velocity on the basis of medium information of media M, such as the thickness, and the transportation route shape for the media M, thereby reducing variations in the arrival timings at which the media M arrive at, for example, the paper-stop-roller pair 131 of the destination apparatus (printing apparatus 101), i.e., variations resulting from the abovementioned difference in route length. Thus, the present embodiment can reduce variations in arrival timing (arrival time) that are associated with the types of media M transported on the transportation paths (the first individual transportation path P1, the second individual transportation path P2, and the joining transportation path P3) that include bent portions (first to fourth bent portions C1-C4). Accordingly, for example, a deviation of abutment timings at which media M abut the paper-stop-roller pair 131 of the printing apparatus 101 can be reduced, thereby preventing a decrease in the image quality, i.e., a printing result, and an occurrence of a jam, both of which could be caused by a variation in the capability to correct skew of the media M.

In the present embodiment, the medium feeding mechanism includes the first feeder 11 and the second feeder 12, i.e., examples of the plurality of feeders, and the transportation path includes: the first individual transportation path P1 and the second individual transportation path P2, i.e., examples of the plurality of individual transportation paths, which are respectively coupled to the first feeder 11 and the second feeder 12 and both (an example of the feature of "at least one") include bent portions (first to third bent portions C1-C3); and the joining transportation path P3, which joins the first individual transportation path P1 and the second individual transportation path P2 together. The control unit 31 adjusts the transportation velocity of media M fed from the first feeder 11 and the second feeder 12 and transported by the first to ninth transportation roller pairs 21-29 on the basis of medium information, such as the thickness of the media M, and the transportation route shape for the media M (the transportation route shape of the section spanning the first individual transportation path P1 and the joining transportation path P3 or the transportation route shape of the section spanning the second individual transportation path P2 and the joining transportation path P3).

Accordingly, for media M fed from the first feeder 11 and for media M fed from the second feeder 12, variations in the arrival timings at which the media M arrive at a destination apparatus such as the printing apparatus 101, i.e., variations resulting from the difference in route length associated with the types of the media M, can be reduced on the basis of medium information, such as thickness, of the media M fed from the first feeder 11 and the second feeder 12 and the transportation route shapes for the media M. Accordingly, when, for example, media M fed from the first feeder 11 and media M fed from the second feeder 12 are transported in an alternating pattern, the intervals at which the media M are fed do not need to be extended to make variations in arrival timing fall within an allowable range, and thus the production efficiency (the feed rate or print rate per medium M) can be suppressed from decreasing.

In the present embodiment, the medium feeding mechanism includes the second entrance passage detection sensor S3 (or first entrance passage detection sensor S1), i.e., an example of the passage detection sensor that is disposed at each of the first individual transportation path P1 and the second individual transportation path P2 and senses passage of media M before arrival at the paper stop sensor S10. The control unit 31 determines a transportation velocity for a medium M on the basis of the deviation between a passage timing (time t11*a* or t11*b*) at which the medium M is sensed by the second entrance passage detection sensor S3, i.e., an example of the passage time, and a reference passage timing (time t11) determined in advance, i.e., an example of the reference passage time, the thickness of the medium M, i.e., an example of the medium information, the transportation route shape for the medium M.

Accordingly, it is possible to reduce variations in the arrival timings at which media M arrive at a destination apparatus such as the printing apparatus 101, i.e., variations resulting from the deviation of the rate of feed of, or the deviation of the timing of starting the feed of, the media M from the first feeder 11 and the second feeder 12 to the first individual transportation path P1 or the second individual transportation path P2.

In the present embodiment, the control unit 31 adjusts the velocity at which following media M are transported by the first to ninth transportation roller pairs 21-29, on the basis of the deviation between the arrival timing (time t13*c* or t13*d* indicated in FIG. 6) of a preceding medium M, i.e., an example of the arrival time, and the reference arrival timing (time t13) determined in advance, i.e., an example of the reference arrival time (the arrival timing is a sensing result provided by the paper stop sensor S10 (or second exit passage detection sensor S4) disposed at the joining transportation path P3, i.e., an example of the arrival detection sensor). In other words, the medium feeding mechanism includes the paper stop sensor S10, i.e., an example of the arrival detection sensor that is disposed at a transportation path and senses arrival of a medium M; and the control unit 31 controls the transporter by determining a transportation velocity for a following medium M on the basis of the thickness of the following medium M, i.e., an example of the medium information, the transportation route shape for the following medium M, and the deviation between the arrival time of a medium M (time t13*c* or t13*d*), i.e., a sensing result provided by the paper stop sensor S10, and the reference arrival time determined in advance (time t13).

Accordingly, the transportation velocity of a following medium M can be adjusted on the basis of the deviation between the reference arrival timing determined in advance (time t13) and the arrival timing at which a medium M preceding the following medium M arrives at the paper stop sensor S10 (time t13*c* or t13*d*). In addition, the transportation velocity of a following medium M is not adjusted after the following medium M is deviated while being transported but is adjusted on the basis of a deviation of a preceding medium M, so that variations in the arrival timings at which media M arrive at a destination apparatus such as the printing apparatus 101 can be easily reduced. Furthermore, a transportation velocity can be adjusted for each of the first individual transportation path P1 and the second individual transportation path P2 when the transportation velocities are deviated differently due to the difference in length in the transportation direction between the first individual transportation path P1 and the second individual transportation path P2 or due to the first individual transportation path P1 and the second individual transportation path P2 having different transportation roller pairs or transportation drivers disposed thereat.

In the present embodiment, the medium feeding mechanism includes the first feeder 11 and the second feeder 12 that feed media M, i.e., examples of the plurality of feeders; the transportation path includes the first individual transportation path P1 and the second individual transportation path P2 respectively coupled to the first feeder 11 and the second feeder 12, i.e., examples of the plurality of individual transportation paths, and the joining transportation path P3 joining the first individual transportation path P1 and the second individual transportation path P2 together; and the transporter includes the first to fifth transportation roller pairs 21-25 and the sixth and seventh transportation roller pairs 26 and 27 that transport media M on the first individual transportation path P1 and the second individual transportation path P2, i.e., examples of the plurality of individual transportation transporters, as well as the eighth and ninth transportation roller pairs 28 and 29 and the reception roller pair 132 that transport media M on the joining transportation path P3, i.e., examples of the joining transporter. The control unit 31 determines a transportation velocity for a following medium M and controls the first to ninth transportation roller pairs 21-29 on the basis of the deviation between the arrival timing (time t13*a* or t13*b*) of a medium M, i.e., an example of the arrival time, and the reference arrival timing (time t13) determined in advance, i.e., an example of the reference arrival time, as well as the thickness of the following medium M, i.e., an example of the medium information, and the transportation route shape for the following medium M (the arrival timing is a sensing result provided by the paper stop sensor S10 (or second exit passage detection sensor S4) disposed at the joining transportation path P3, i.e., an example of the arrival detection sensor).

As described above, the control unit 31 can adjust the transportation velocity for the first individual transportation path P1 coupled to the first feeder 11, the transportation velocity for the second individual transportation path P2 coupled to the second feeder 12, and the transportation velocity for the joining transportation path P3 on the basis of a deviation between the timing of arrival at the paper stop sensor S10 (time t13*c* or t13*d*) and the reference arrival timing determined in advance (time t13). Thus, a transportation velocity can be adjusted for each of the first individual transportation path P1 and the second individual transportation path P2 when the transportation velocities are deviated differently due to the difference in length in the transportation direction between the first individual transportation path P1 and the second individual transportation path P2 or due to the first individual transportation path P1 and the second individual transportation path P2 having different transportation roller pairs or transportation drivers disposed thereat. In addition, the transportation velocity of a following medium M is not adjusted after the following medium M is deviated while being transported but is adjusted on the basis of the deviation of a preceding medium M, so that a deviation of the timing of arrival at the paper stop sensor S10 (printing apparatus 101) can be easily reduced. Furthermore, the transportation velocity of media M can be adjusted in the medium feeding apparatus 1 without the need for the adjustment of the transportation velocity in the printing apparatus 101, so that a deviation of the transportation velocity that could occur if adjustments are made in the medium feeding apparatus 1 and the printing apparatus 101 can be prevented from occurring, in comparison to when the transportation velocity of the medium feeding apparatus 1 and the transportation velocity of the printing apparatus 101 are adjusted. Hence, the present embodiment can reduce deviations of the arrival timings (arrival times) at which media M fed from the first feeder 11 and the second feeder 12 arrive at the printing apparatus 101.

In the present embodiment, the medium feeding mechanism further includes the second entrance passage detection sensor S3 (or first entrance passage detection sensor S1), i.e., an example of the plurality of passage detection sensors that are disposed at the first individual transportation path P1 and the second individual transportation path P2 and sense passage of media M before arrival at the paper stop sensor S10. The control unit 31 determines a transportation velocity for a following medium M on the basis of the deviation between a passage timing (time t11*a* or t11*b*) at which the following medium M is sensed by the second entrance passage detection sensor S3, i.e., an example of the passage time, and a reference passage timing (time t11) determined in advance, i.e., an example of the reference passage time, the deviation between the arrival timing of a medium M preceding the following medium M (time t13*c* or t13*d*) and the reference arrival timing (time t13), the thickness of the following medium M, i.e., an example of the medium information, and the transportation route shape for the following medium M.

Accordingly, the deviation of the time of arrival at the paper stop sensor S10, and thus deviation of the time of arrival at the paper-stop-roller pair 131, can be reduced when the rate of feed, or the timing of starting the feed of, media M from the first feeder 11 and the second feeder 12 to the second individual transportation path P2 (or first individual transportation path P1) is deviated.

In the present embodiment, the first individual transportation path P1 and the second individual transportation path P2 are different in length in the transportation direction, and for each of the first individual transportation path P1 and the second individual transportation path P2, the control unit 31 makes an adjustment as to how many media M are to be transported during the period from the transportation of a preceding medium M to the transportation of a following medium M for which a transportation velocity is to be determined on the basis of the deviation between the arrival timing of the preceding medium M (time t13*c* or t13*d*) and the reference arrival timing (time t13).

Accordingly, the deviation between the arrival timing at which a preceding medium M arrives at the paper stop sensor S10 (time t13*c* or t13*d*) and the reference arrival timing (time t13) can be reduced as soon as possible for a following medium M, for each of the first individual transportation path P1 and the second individual transportation path P2 that are different in length.

In the present embodiment, the control unit 31 determines a transportation velocity for a following medium M such that the deviation between the arrival timing (time t13*c* or t13*d*) and the reference arrival timing (time t13) is partly eliminated.

In the meantime, if, for example, the control unit 31 makes an adjustment to increase the transportation velocity of a following medium M, the (n+1)-th medium M depicted in FIG. 15 (medium Mc after correction), for which the transportation velocity is increased to eliminate the deviation between the arrival timing of the preceding medium M (time t13*c* or t13*d*) and the reference arrival timing (time t13), could cause a jam by colliding with the immediately preceding n-th medium M abutting the paper-stop-roller pair 131, or make it impossible to ensure the time required to change the rotational velocity of the first to ninth transportation roller pairs 21-29 by means of the space between the n-th medium M and the (n+1)-th medium M. In the present embodiment, by contrast, a deviation is gradually eliminated, so that the interval between a n-th medium M and a (n+1)-th medium M can be prevented from being drastically varied, thereby reducing the occurrence of jam and ensuring the time to change the rotational velocity of the first to ninth transportation roller pairs 21-29.

In the present embodiment, the control unit 31 determines a transportation velocity for a following medium M on the basis of a table associating deviations between arrival timings (time t13*a* or t13*b*) and the reference arrival timing (time t13) with the amounts of correction of arrival timing, i.e. examples of the arrival time correction amount, which are determined according to the transportation velocity of media M and the intervals at which the media M are fed, as well as the thickness of the following medium M, i.e., an example of the medium information, and the transportation route shape for the following medium M.

Accordingly, the control unit 31 can determine the amount of correction of arrival timing through the simple process of referring to the table. In addition, for example, as the intervals at which media M are fed becomes longer or as the transportation velocity becomes lower, the reduction in the amount of correction of arrival timing can be decreased or eliminated with respect to the deviation of the arrival timing. Thus, the amount of correction of arrival timing can be increased while reducing the occurrence of a jam and ensuring the time to change the rotational velocity of the first to ninth transportation roller pairs 21-29, so that the arrival timing can be brought close to the reference arrival timing.

Another Embodiment

The printing system in the present embodiment can include components similar to those in the printing system 100 indicated herein with reference to the above-described one embodiment. Thus, descriptions of matters in the present embodiment overlapping those in the above-described one embodiment are omitted herein.

Figure 9:
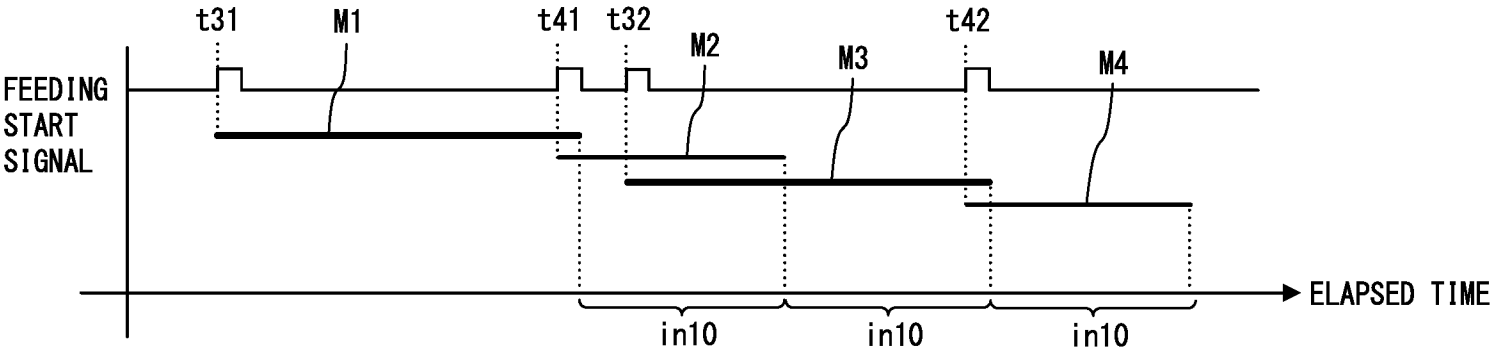
FIG. 9 indicates the transportation times of media fed from a first feeder (thick lines) and a second feeder (thin lines) in another embodiment (first feeder v0=second feeder v0)

FIG. 9 indicates the transportation times of media M fed from a first feeder 11 (thick lines) and a second feeder 12 (thin lines) in another embodiment (first feeder v0=second feeder v0).

Figure 10:
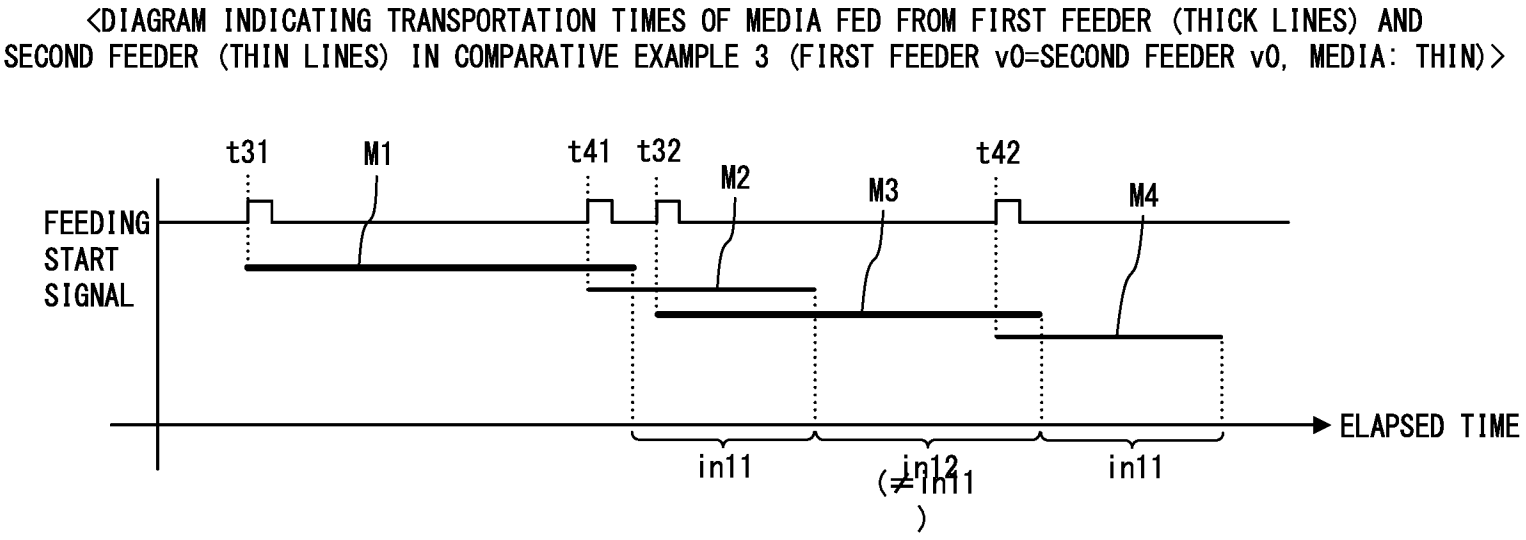
FIG. 10 indicates the transportation times of media fed from a first feeder (thick lines) and a second feeder (thin lines) in comparative example 3 (first feeder v0=second feeder v0, media: thin)

FIG. 10 indicates the transportation times of media M fed from a first feeder 11 (thick lines) and a second feeder 12 (thin lines) in comparative example 3 (first feeder v0=second feeder v0; media: thin).

Figure 11:
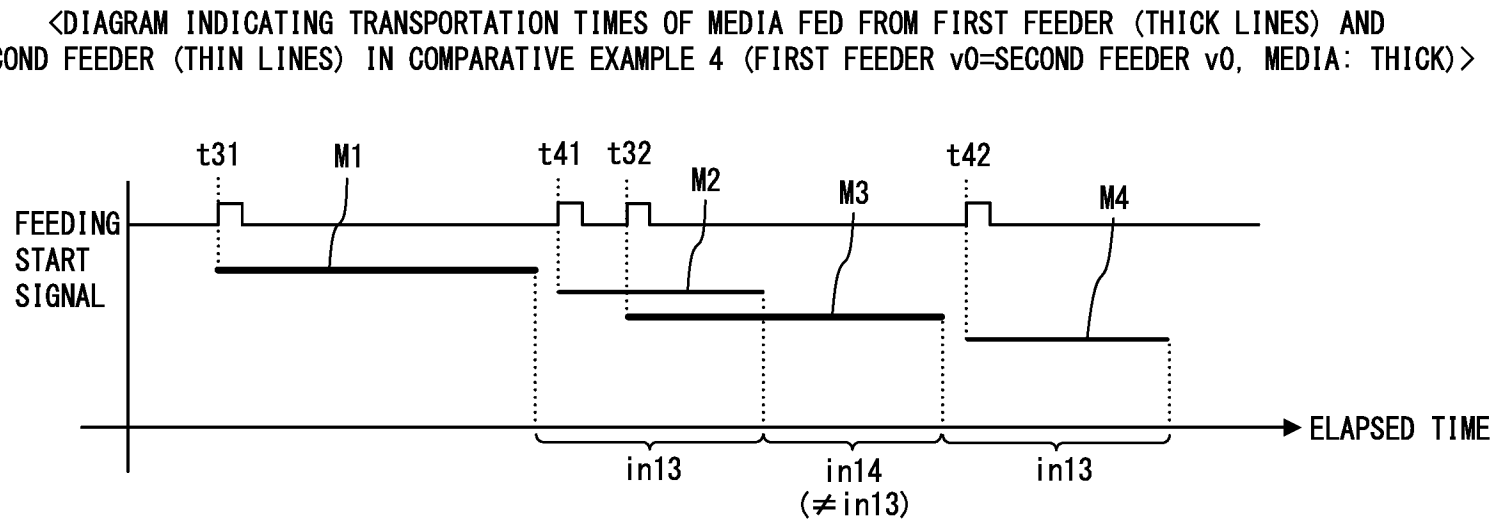
FIG. 11 indicates the transportation times of media fed from a first feeder (thick lines) and a second feeder (thin lines) in comparative example 4 (first feeder v0=second feeder v0, media: thick)

FIG. 11 indicates the transportation times of media M fed from a first feeder 11 (thick lines) and a second feeder 12 (thin lines) in comparative example 4 (first feeder v0=second feeder v0; media: thick).

Figure 12:
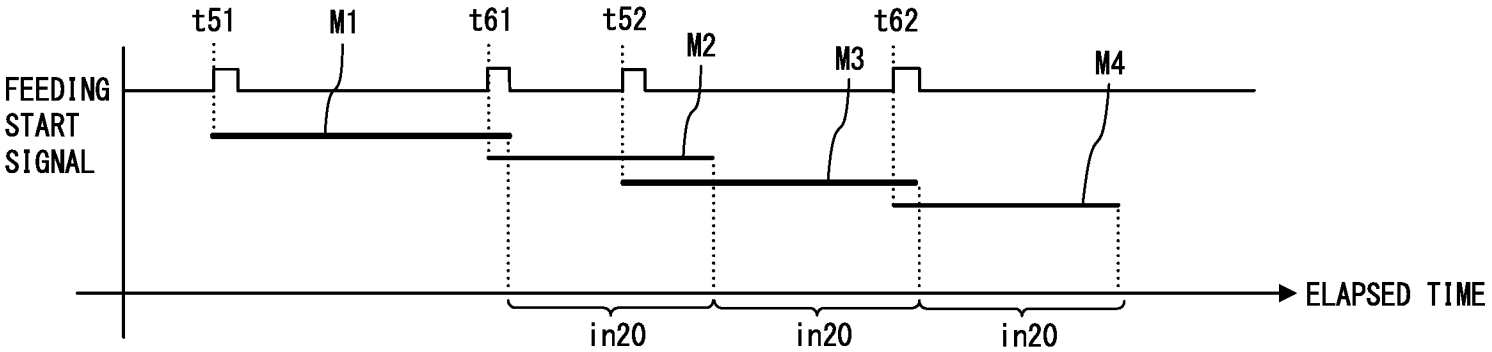
FIG. 12 indicates the transportation times of media fed from a first feeder (thick lines) and a second feeder (thin lines) in another embodiment (first feeder v0>second feeder v0)

FIG. 12 indicates the transportation times of media M fed from a first feeder 11 (thick lines) and a second feeder 12 (thin lines) in another embodiment (first feeder v0>second feeder v0).

Figure 13:
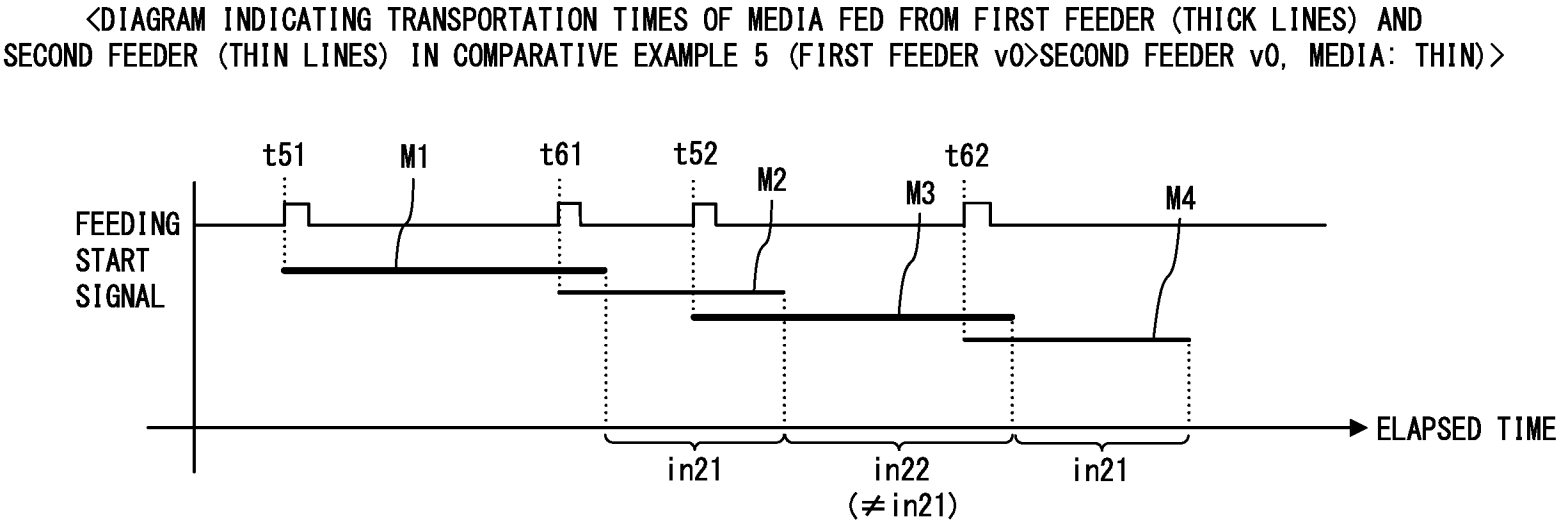
FIG. 13 indicates the transportation times of media fed from a first feeder (thick lines) and a second feeder (thin lines) in comparative example 5 (first feeder v0>second feeder v0, medium: thin)

FIG. 13 indicates the transportation times of media M fed from a first feeder 11 (thick lines) and a second feeder 12 (thin lines) in comparative example 5 (first feeder v0>second feeder v0; media: thin).

Figure 14:
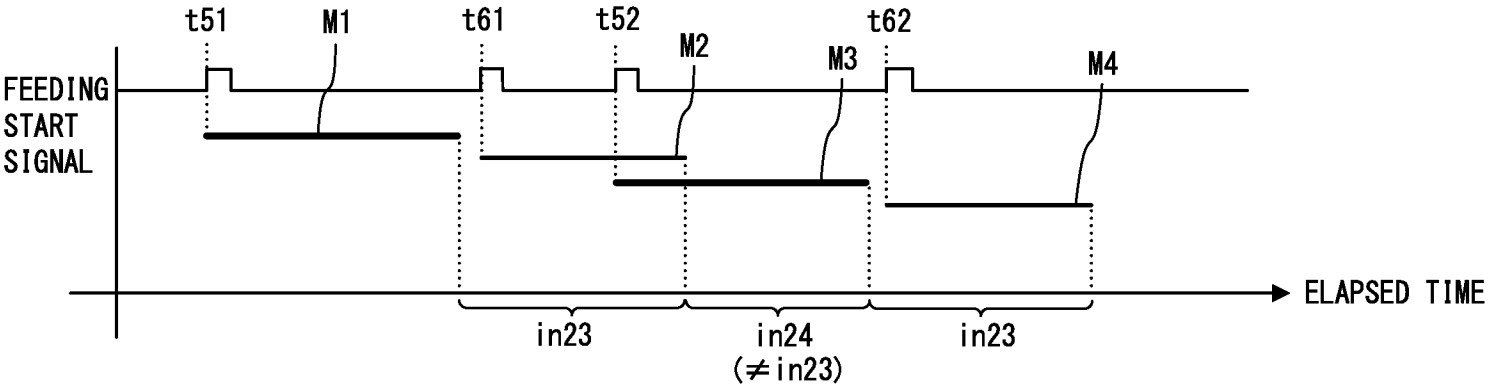
FIG. 14 indicates the transportation times of media fed from a first feeder (thick lines) and a second feeder (thin lines) in comparative example 6 (first feeder v0>second feeder v0, media: thick)

FIG. 14 indicates the transportation times of media M fed from a first feeder 11 (thick lines) and a second feeder 12 (thin lines) in comparative example 6 (first feeder v0>second feeder v0; media: thick).

In the examples in FIGS. 9-11, a reference transportation velocity v0 of a medium M fed from the first feeder 11 is equal to a reference transportation velocity v0 of a medium M fed from the second feeder 12. In the examples in FIGS. 12-14, a reference transportation velocity v0 of a medium M fed from the first feeder 11 is higher than a reference transportation velocity v0 of a medium M fed from the second feeder 12.

Consideration is given to a situation in which, as indicated in FIGS. 9 and 12, a medium M fed from the first feeder 11 (medium M1), a medium M fed from the second feeder 12 (medium M2), a medium M fed from the first feeder 11 (medium M3), and a medium M fed from the second feeder 12 (medium M4) arrive, in the stated order, at the paper-stop-roller pair 131 (the right ends of thick lines and thin lines in the figures) at constant arrival intervals in10 or constant intervals in20 (examples of the reference arrival time), i.e., media M fed from the first feeder 11 and media M fed from the second feeder 12 arrive at the paper-stop-roller pair 131 in an alternating pattern (with the feeders switched consecutively at least twice). The reference arrival time, an example of which is the constant arrival intervals in10 or in20, could vary for each single medium M or each of the feeders (first feeder 11 or second feeder 12) according to the size of the medium M, details of printing (printing time at the printing unit 110), or the like. However, consideration is given hereat to a situation in which A3-size media M1-M4 arrive at the paper-stop-roller pair 131 at the constant arrival intervals in10 or in20.

In this situation, since the first individual transportation path P1 depicted in FIG. 1 is, as described above, longer in the transportation direction of media M than the second individual transportation path P2, the transportation time of the media M1 and M3 fed from the first feeder 11 are longer than that of the media M2 and M4 fed from the second feeder 12 when the transportation velocities of the first individual transportation path P1 and the second individual transportation path P2 are equal.

Accordingly, the feeding start times t31 and t32 or t51 and t52 of the media M1 and M3 from the first feeder 11 are set to precede the feeding start times t41 and t42 or t61 and t62 of the media M2 and M4 from the second feeder 12, in view of a comparison between the times of arrival at the paper-stop-roller pair 131. Furthermore, in order to allow media M to arrive at the paper-stop-roller pair 131 at the constant arrival intervals in10 or in20, the control unit 31 also performs, as indicated in FIGS. 4-6, the above-described adjustments of transportation velocities, such as the adjustment of the transportation velocities of media M performed using the first to ninth transportation roller pairs 21-29 on the basis of the thickness of the media M, i.e., an example of the medium information, and the transportation route shape for the media M.

Although the media M1-M4 reach at the constant arrival intervals in10 or in20, the intervals between the feeding start times of the media M1-M4 are not constant. Accordingly, if the feeding start times of the media M1-M4 are made constant, the times of arrival at the paper-stop-roller pair 131 will not be constant due to a difference in length in the transportation direction between the first individual transportation path P1 and the second individual transportation path P2.

The transportation velocity of the first individual transportation path P1, which is longer than the second individual transportation path P2 in the transportation direction, may be adjusted to be higher than the transportation velocity of the second individual transportation path P2, such that the intervals between the feeding start times of the media M1-M4 become constant and the intervals between the arrival times at which the media M1-M4 arrive at the paper-stop-roller pair 131 become constant. When the transportation velocities of the first individual transportation path P1 and the second individual transportation path P2 are adjusted like this, it will be effective to adjust, as described above, the transportation velocities of media M transported by the first to ninth transportation roller pairs 21-29 on the basis of the thickness of the media M and the transportation route shapes for the media M.

In the meantime, the first individual transportation path P1 includes the second bent portion C2 and the first bent portion C1 having, as depicted in FIGS. 3A-3C, a larger corner angle than the third bent portion C3 of the second individual transportation path P2, so the difference between the length of a path taken by a medium M consisting of thick paper Ma when being transported on the first individual transportation path P1 and the length of a path taken by a medium M consisting of thin paper Mb when being transported on the first individual transportation path P1 will be larger than the difference between the length of a path taken by a medium M consisting of thick paper Ma when being transported on the second individual transportation path P2 and the length of a path taken by a medium M consisting of thin paper Mb when being transported on the second individual transportation path P2. Thus, assuming that the media M1-M4 are thin paper, the transportation route lengths tend to extend more easily on the first individual transportation path P1 than on the second individual transportation path P2. Assuming that the media M1-M4 are thick paper, the transportation route lengths tend to be shortened more easily on the first individual transportation path P1 than on the second individual transportation path P2.

Accordingly, in a case where the control unit 31 does not adjust the transportation velocity of media M transported by the first to ninth transportation roller pairs 21-29 on the basis of the thickness of the media M and the transportation route shape for the media M, assuming that the media M1-M4 are thin paper, the transportation times of the media M1 and M3 fed from the first feeder 11 will be more susceptible to an influence pertaining to the fact that the media are thin paper (time extension) than the transportation times of the media M2 and M4 fed from the second feeder. Accordingly, unlike the constant arrival intervals in10 or in20 in FIGS. 9 and 12, the arrival interval in11 or in21 between the moments at which the media M1 and M3 fed from the first feeder 11 arrive at the paper-stop-roller pair 131 and the moments at which the media M2 and M4 fed from the second feeder 12 arrive at the paper-stop-roller pair 131 are, as indicated in FIG. 10 (comparative example 3) and FIG. 13 (comparative example 5), shorter than the arrival interval in12 or in22 between the moment at which the medium M2 fed from the second feeder 12 arrives at the paper-stop-roller pair 131 and the moment at which the medium M3 fed from the first feeder 11 arrives at the paper-stop-roller pair 131.

In a case where the control unit 31 does not adjust the transportation velocity of media M transported by the first to ninth transportation roller pairs 21-29 on the basis of the thickness of the media M and the transportation route shape for the media M, assuming that the media M1-M4 are thick paper, the transportation times of the media M1 and M3 fed from the first feeder will be more susceptible to an influence pertaining to the fact that the media are thick paper (time shortening) than the transportation times of the media M2 and M4 fed from the second feeder. Accordingly, unlike the constant arrival intervals in10 or in20 in FIGS. 9 and 12, the arrival interval in13 or in23 between the moments at which the media M1 and M3 fed from the first feeder 11 arrive at the paper-stop-roller pair 131 and the moments at which the media M2 and M4 fed from the second feeder 12 arrive at the paper-stop-roller pair 131 are, as indicated in FIG. 11 (comparative example 4) and FIG. 14 (comparative example 6), longer than the arrival interval in14 or in24 between the moment at which the medium M2 fed from the second feeder 12 arrives at the paper-stop-roller pair 131 and the moment at which the medium M3 fed from the first feeder 11 arrives at the paper-stop-roller pair 131.

If the arrival intervals in11-in14 or in21-in24 are inconstant as in the examples in FIGS. 10, 11, 13, and 14, abutment timings at which media M abut the paper-stop-roller pair 131 of the printing apparatus 101 will be deviated as described above, and hence, due to a variation in the capability to correct skew of the media M, the image quality, i.e., a printing result, could be decreased, or a jam could occur. Alternatively, in order to prevent the image quality from decreasing or prevent a jam from occurring, the arrival intervals could be extended in consideration of variations therebetween, resulting in a reduction in the production efficiency. Accordingly, the transportation velocities of media M transported by the first to ninth transportation roller pairs 21-29 will desirably be adjusted, as described above, on the basis of the thickness of the media M and the transportation route shape for the media M, so as to make the arrival intervals in10 or in20 constant as indicated in FIGS. 9 and 12.

In a case where the feeders are not frequently switched, e.g., in a case where the media M placed on the placement mount 12*a* of the second feeder 12 starts to be fed after the feeding of all of the media M placed on the placement mount 11*a* of the first feeder 11 has been finished, the arrival intervals tend to be constant because media M successively fed from the same feeder (first feeder 11 or second feeder 12) should be transported under the same conditions in terms of the thickness of the media M (medium information) and the transportation route shape for the media M. Thus, when the feeders are not frequently switched, variations between the arrival intervals that could occur in switching the feeders may be ignored. When variations between arrival intervals are ignored like this, the time at which the paper-stop-roller pair 131 starts a taking-in operation or the time at which the printing unit 110 starts printing is unlikely to affect printing on media M as long as such a time is determined on the basis of the timings at which the paper-stop-roller pair S10 senses the media M.

The other embodiment described so far can exhibit similar effects to the above-described embodiment in terms of similar matters, e.g., the effect of reducing variations in arrival time that are associated with the types of media M transported on transportation paths that include bent portions.

In the present embodiment, the first individual transportation path P1 is longer than the second individual transportation path P2 in the transportation direction of media M; and the control units 31 and 151 determine feeding start times t31 and t32 or t51 and t52 at which the first feeder 11 is to feed media M1 and M3 and feeding start times t41 and t42 or t61 and t62 at which the second feeder 12 is to feed media M2 and M4, such that the media M1 and M3 fed from the first feeder 11 and the media M2 and M4 fed from the second feeder 12 arrive at a reference arrival position (e.g., paper-stop-roller pair 131) on the joining transportation path P3 at reference arrival times (e.g., at constant arrival intervals in10 or in20).

Accordingly, in comparison to when the first feeder 11 or the second feeder 12 feeds media M at constant intervals, media M1 and M3 fed from the first feeder 11 and media M2 and M4 fed from the second feeder 12 can arrive at the paper-stop-roller pair 131 or the like at reference arrival times (e.g., at constant arrival intervals in10 or in20), without the need to perform a velocity correction for eliminating the difference in length in the transportation direction between the first individual transportation path P1 and the second individual transportation path P2. Accordingly, the reducing of variations in the arrival times of media M by adjusting, as described above, the transportation velocity on the basis of medium information, such as the thickness of the media M, and the transportation route shape for the media M can be started at a desired reference arrival time (e.g., constant arrival intervals in10 or in20).

In the present embodiment, the control units 31 and 151 determine feeding start times t31 and t32 or t51 and t52 at which the first feeder 11 is to feed media M1 and M3 and feeding start times t41 and t42 or t61 and t62 at which the second feeder 12 is to feed media M2 and M4, such that the media M1 and M3 fed from the first feeder 11 and the media M2 and M4 fed from the second feeder 12 arrive at a reference arrival position (e.g., paper-stop-roller pair 131) in an alternating pattern (with the feeders switched consecutively at least twice) at reference arrival times (e.g., at constant arrival intervals in10 or in20).

Accordingly, although the first individual transportation path P1 and the second individual transportation path P2 have different lengths and different transportation route shapes in the transportation direction, media M1 and M3 fed from the first feeder 11 and media M2 and M4 fed from the second feeder 12 can arrive at the paper-stop-roller pair 131 in an alternating pattern at desired reference arrival times (e.g., at constant arrival intervals in10 or in20).

The present invention is not simply limited to the embodiments described herein. Components of the embodiments may be embodied in a varied manner in an implementation phase without departing from the gist of the invention. A plurality of components disclosed with reference to the described embodiments may be combined, as appropriate, to achieve various inventions. For example, all of the components indicated with reference to embodiments may be combined as appropriate. Accordingly, various variations and applications can be provided, as a matter of course, without departing from the gist of the invention. The following indicates appendixes.

One medium feeding mechanism comprises:

a feeder that feeds a medium;

a transportation path that is coupled to the feeder and includes a bent portion;

a transporter that transports the medium on the transportation path; and a transportation control unit that controls the transporter, wherein the transportation control unit adjusts a transportation velocity of the medium transported by the transporter on the basis of medium information of the medium and a transportation route shape for the medium.

Another medium feeding mechanism comprises:

a plurality of said feeders, wherein the transportation path includes a plurality of individual transportation paths each coupled to each of the plurality of feeders, and a joining transportation path joining the plurality of individual transportation paths together, at least one of the plurality of individual transportation paths including the bent portion, and the transportation control unit adjusts a transportation velocity of a medium fed from each of the plurality of feeders and transported by the transporter on the basis of medium information of the medium and a transportation route shape for the medium.

Another medium feeding mechanism comprises:

a passage detection sensor that is disposed at the transportation path and senses passage of a medium, wherein the transportation control unit adjusts a transportation velocity of a medium transported by the transporter on the basis of a deviation between a passage time at which the passage detection sensor senses a medium and a reference passage time determined in advance, medium information of the medium, and a transportation route shape for the medium.

Another medium feeding mechanism is such that the plurality of feeders include first and second feeders, the plurality of individual transportation paths include a first individual transportation path coupled to the first feeder and a second individual transportation path coupled to the second feeder, the first individual transportation path is longer in a transportation direction of a medium than the second individual transportation path, and the transportation control unit determines a feeding start times at which the first feeder is to feed media and feeding start times at which the second feeder is to feed media, such that the media fed from the first feeder and the media fed from the second feeder arrive at a reference arrival position on the joining transportation path at reference arrival times.

Another medium feeding mechanism is such that the transportation control unit determines a feeding start times at which the first feeder is to feed media and feeding start times at which the second feeder is to feed media, such that the media fed from the first feeder and the media fed from the second feeder arrive at the reference arrival position in an alternating pattern at the reference arrival times.

Another medium feeding mechanism comprises:

an arrival detection sensor that is disposed at the transportation path and senses arrival of a medium, wherein the transportation control unit controls the transporter by determining a transportation velocity for a following medium on the basis of a deviation between an arrival time of a medium and a reference arrival time determined in advance, medium information of the following medium, and a transportation route shape for the following medium, the arrival time being a sensing result provided by the arrival detection sensor disposed.

Another medium feeding mechanism comprises:

a plurality of feeders that feed media, wherein the transportation path includes a plurality of individual transportation paths each coupled to each of the plurality of feeders and a joining transportation path joining the plurality of individual transportation paths together, and the transporter includes a plurality of individual transporters for transporting media on the plurality of individual transportation paths and a joining transporter for transporting the media on the joining transportation path, and the transportation control unit controls the plurality of individual transporters and the joining transporter by determining a transportation velocity for a following medium on the basis of the deviation between an arrival time of a medium and a reference arrival time determined in advance, medium information of the following medium, and a transportation route shape for the following medium, the arrival time being a sensing result provided by an arrival detection sensor disposed at the joining transportation path.

Another medium feeding mechanism further comprises:

a plurality of passage detection sensors that are each disposed at each of the plurality of individual transportation paths and sense passage of a medium before arrival at the arrival detection sensor, wherein the transportation control unit determines a transportation velocity for a following medium on the basis of a deviation between a passage time at which the passage detection sensor senses the following medium and a reference passage time determined in advance, a deviation between an arrival time of a medium preceding the following medium and the reference arrival time, medium information of the following medium, and a transportation route shape for the following medium.

Another medium feeding mechanism is such that the plurality of individual transportation paths are different in length in a transportation direction, and for each of the plurality of individual transportation paths, the transportation control unit makes an adjustment as to how many media are to be transported during a period from transportation of a preceding medium and transportation of a following medium for which a transportation velocity is to be determined on the basis of the deviation between an arrival time of the preceding medium and the reference arrival time.

Another medium feeding mechanism is such that the transportation control unit determines a transportation velocity for the following medium such that the deviation between the arrival time and the reference arrival time is partly eliminated.

Another medium feeding mechanism is such that the transportation control unit determines a transportation velocity for the following medium on the basis of medium information of the following medium, a transportation route shape for the following medium, and a table associating the deviation between the arrival time and the reference arrival time with an arrival time correction amount determined according to a transportation velocity of media and intervals at which the media are fed.

What is claimed is:

1. A medium feeding mechanism comprising:

a feeder that feeds media, the media including at least a first medium and a second medium;

a transportation path that is coupled to the feeder and includes a bent portion;

a transporter that transports each of the media on the transportation path; and a transportation control unit that controls the transporter, wherein the transportation control unit sets different transportation velocities for the media transported by the transporter, the different transportation velocities being set based on a transportation route shape on the transportation path for the media and medium information of the media, the transportation route shape on the transportation path being configured to transport the first medium along a different route length than that of the second medium along a same area of the transportation path.

2. The medium feeding mechanism of claim 1, further comprising:

a plurality of said feeders, wherein the transportation path includes a plurality of individual transportation paths each coupled to each of the plurality of feeders, and a joining transportation path joining the plurality of individual transportation paths together, at least one of the plurality of individual transportation paths including the bent portion, and the transportation control unit adjusts a transportation velocity of a medium fed from each of the plurality of feeders and transported by the transporter on the basis of medium information of the medium and the transportation route shape.

3. The medium feeding mechanism of claim 2, wherein the plurality of feeders include first and second feeders, the plurality of individual transportation paths include a first individual transportation path coupled to the first feeder and a second individual transportation path coupled to the second feeder, the first individual transportation path is longer in a transportation direction of a medium than the second individual transportation path, and the transportation control unit determines feeding start times at which the first feeder is to feed media and feeding start times at which the second feeder is to feed media, such that the media fed from the first feeder and the media fed from the second feeder arrive at a reference arrival position on the joining transportation path at reference arrival times.

4. The medium feeding mechanism of claim 3, wherein the transportation control unit determines feeding start times at which the first feeder is to feed media and feeding start times at which the second feeder is to feed media, such that the media fed from the first feeder and the media fed from the second feeder arrive at the reference arrival position in an alternating pattern at the reference arrival times.

5. The medium feeding mechanism of claim 1, further comprising:

a passage detection sensor that is disposed at the transportation path and senses passage of a medium, wherein the transportation control unit adjusts a transportation velocity of a medium transported by the transporter on the basis of a deviation between a passage time at which the passage detection sensor senses a medium and a reference passage time determined in advance, medium information of the medium, and the transportation route shape.

6. The medium feeding mechanism of claim 1, further comprising:

an arrival detection sensor that is disposed at the transportation path and senses arrival of a medium, wherein the transportation control unit controls the transporter by determining a transportation velocity for a following medium on the basis of a deviation between an arrival time of a medium and a reference arrival time determined in advance, medium information of the following medium, and the transportation route shape for the following medium, the arrival time being a sensing result provided by the arrival detection sensor.

7. The medium feeding mechanism of claim 6, further comprising:

a plurality of feeders that feed media, wherein the transportation path includes a plurality of individual transportation paths each coupled to each of the plurality of feeders and a joining transportation path joining the plurality of individual transportation paths together, and the transporter includes a plurality of individual transporters for transporting media on the plurality of individual transportation paths and a joining transporter for transporting the media on the joining transportation path, and the transportation control unit controls the plurality of individual transporters and the joining transporter by determining a transportation velocity for a following medium on the basis of a deviation between an arrival time of a medium and a reference arrival time determined in advance, medium information of the following medium, and the transportation route shape for the following medium, the arrival time being a sensing result provided by an arrival detection sensor disposed at the joining transportation path.

8. The medium feeding mechanism of claim 7, further comprising:

a plurality of passage detection sensors that are each disposed at each of the plurality of individual transportation paths and sense passage of a medium before arrival at the arrival detection sensor, wherein the transportation control unit determines a transportation velocity for a following medium on the basis of a deviation between a passage time at which the passage detection sensor senses the following medium and a reference passage time determined in advance, a deviation between an arrival time of a medium preceding the following medium and the reference arrival time, medium information of the following medium, and the transportation route shape for the following medium.

9. The medium feeding mechanism of claim 7, wherein the plurality of individual transportation paths are different in length in a transportation direction, and for each of the plurality of individual transportation paths, the transportation control unit makes an adjustment as to how many media are to be transported during a period from transportation of a preceding medium and transportation of a following medium for which a transportation velocity is to be determined on the basis of a deviation between an arrival time of the preceding medium and the reference arrival time.

10. The medium feeding mechanism of claim 6, wherein the transportation control unit determines a transportation velocity for the following medium such that the deviation between the arrival time and the reference arrival time is partly eliminated.

11. The medium feeding mechanism of claim 10, wherein the transportation control unit determines a transportation velocity for the following medium on the basis of the medium information of the following medium, the transportation route shape for the following medium, and a table associating the deviation between the arrival time and the reference arrival time with an arrival time correction amount determined according to a transportation velocity of media and intervals at which the media are fed.

12. The medium feeding mechanism of claim 1, wherein the transportation control unit adjusts a transportation velocity of the media transported by the transporter on the basis of a difference in expected transport length of the media caused by a thickness or a material of the media and a degree of the bent portion.

13. A medium feeding mechanism comprising:

a plurality of feeders includes first and second feeders that feed media;

a transportation path that is coupled to the plurality of feeders;

a transporter that transports the medium on the transportation path; and a transportation control unit that controls the transporter, wherein the transportation control unit adjusts a transportation velocity of the medium transported by the transporter on the basis of medium information of the medium and a transportation route shape for the medium, the transportation path includes a plurality of individual transportation paths each coupled to each of the plurality of feeders, and a joining transportation path joining the plurality of individual transportation paths together, at least one of the plurality of individual transportation paths including a bent portion, the transportation control unit adjusts a transportation velocity of a medium fed from each of the plurality of feeders and transported by the transporter on the basis of medium information of the medium and a transportation route shape for the medium, the plurality of individual transportation paths include a first individual transportation path coupled to the first feeder and a second individual transportation path coupled to the second feeder, the first individual transportation path is longer in a transportation direction of a medium than the second individual transportation path, and the transportation control unit determines feeding start times at which the first feeder is to feed media and feeding start times at which the second feeder is to feed media, such that the media fed from the first feeder and the media fed from the second feeder arrive at a reference arrival position on the joining transportation path at reference arrival times.

14. A medium feeding mechanism comprising:

a plurality of feeders that feed media;

a transportation path that is coupled to the plurality of feeders and includes a bent portion;

a transporter that transports the medium on the transportation path;

a transportation control unit that controls the transporter; and an arrival detection sensor that is disposed at the transportation path and senses arrival of a medium, wherein the transportation control unit adjusts a transportation velocity of the medium transported by the transporter on the basis of medium information of the medium and a transportation route shape for the medium, the transportation control unit controls the transporter by determining a transportation velocity for a following medium on the basis of a deviation between an arrival time of a medium and a reference arrival time determined in advance, medium information of the following medium, and a transportation route shape for the following medium, the arrival time being a sensing result provided by the arrival detection sensor, the transportation path includes a plurality of individual transportation paths each coupled to each of the plurality of feeders and a joining transportation path joining the plurality of individual transportation paths together, and the transporter includes a plurality of individual transporters for transporting media on the plurality of individual transportation paths and a joining transporter for transporting the media on the joining transportation path, and the transportation control unit controls the plurality of individual transporters and the joining transporter by determining a transportation velocity for a following medium on the basis of a deviation between an arrival time of a medium and a reference arrival time determined in advance, medium information of the following medium, and a transportation route shape for the following medium, the arrival time being a sensing result provided by an arrival detection sensor disposed at the joining transportation path.

15. A medium feeding mechanism comprising:

a feeder that feeds a medium;

a transportation path that is coupled to the feeder and includes a bent portion;

a transporter that transports the medium on the transportation path;

a transportation control unit that controls the transporter; and an arrival detection sensor that is disposed at the transportation path and senses arrival of a medium, wherein the transportation control unit adjusts a transportation velocity of the medium transported by the transporter on the basis of medium information of the medium and a transportation route shape for the medium, the transportation control unit controls the transporter by determining a transportation velocity for a following medium on the basis of a deviation between an arrival time of a medium and a reference arrival time determined in advance, medium information of the following medium, and a transportation route shape for the following medium, the arrival time being a sensing result provided by the arrival detection sensor, and the transportation control unit determines a transportation velocity for the following medium such that the deviation between the arrival time and the reference arrival time is partly eliminated.

* * * * *